US007802878B2

(12) United States Patent
Kyoso

(10) Patent No.: US 7,802,878 B2
(45) Date of Patent: Sep. 28, 2010

(54) LIQUID DROPLET EJECTION MECHANISM AND IMAGE FORMING APPARATUS

(75) Inventor: Tadashi Kyoso, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 477 days.

(21) Appl. No.: 11/987,643

(22) Filed: Dec. 3, 2007

(65) Prior Publication Data

US 2008/0136860 A1 Jun. 12, 2008

(30) Foreign Application Priority Data

Dec. 6, 2006 (JP) ..... 2006-329290

(51) Int. Cl.
*B41J 2/175* (2006.01)

(52) U.S. Cl. ..... 347/85; 347/7; 347/5

(58) Field of Classification Search ..... 347/5, 347/7, 9, 19, 85, 86, 89
See application file for complete search history.

(56) References Cited

U.S. PATENT DOCUMENTS 5,485,187 A * 1/1996 Okamura et al. ..... 347/85
6,155,664 A * 12/2000 Cook ..... 347/7

FOREIGN PATENT DOCUMENTS

WO WO 00/38928 A1 7/2000

* cited by examiner

*Primary Examiner*—Lam S Nguyen
(74) *Attorney, Agent, or Firm*—Birch, Stewart, Kolasch & Birch, LLP

(57) ABSTRACT

The liquid droplet ejection mechanism includes: a first ink tank and a second ink tank which store ink; a plurality of ink chamber units which are capable of ejecting the ink; a first common flow channel which connects the first ink tank with the plurality of ink chamber units; and a second common flow channel which connects the second ink tank with the plurality of ink chamber units, wherein: the ink supplied from the first ink tank circulates in such a manner that the ink flows through the first common flow channel, the ink chamber units that do not eject the ink, and the second common flow channel to the second ink tank to be recovered in the second ink tank; the plurality of ink chamber units include a nearest connection ink chamber unit which is connected to the first ink tank at the shortest distance from the first ink tank, of the plurality of ink chamber units, and is also connected to the second ink tank at the shortest distance from the second ink tank, of the plurality of ink chamber units; and taking pressure in the first ink tank to be $P_i$, taking pressure in the second ink tank to be $P_o$, taking volume of the ink circulated per unit time from the first ink tank to the second ink tank when the plurality of ink chamber units do not eject the ink to be $U_o$, taking the ratio between volume of the ink supplied per unit time from the ink supply channel and volume of ink supplied per unit time from the ink circulation channel when the ink is being ejected from at least one of the ink chamber units to be $\alpha_i:\alpha_o$, taking total volume of the ink ejected per unit time from all of the ink chamber units which are ejecting ink to be Q, taking flow channel resistance from a connection section with the first ink tank to a connection section with the nearest connection ink chamber unit in the first common flow channel to be $R_i$, taking the flow channel resistance from a connection section with the second ink tank to a connection section with the nearest connection ink chamber unit in the second common flow channel to be $R_{o1}$, taking flow channel resistance in the first common flow channel between mutually adjacent ink chamber units to be $R_1$, taking the flow channel resistance in the second common flow channel between mutually adjacent ink chamber units to be $R_2$, and taking the total number of ink chamber units to be Z, both following conditions are satisfied:

$$\{Pi-Ri\times(\alpha_i\times Q+U_o)\}\geqq\{P_o-R_{o1}\times(\alpha_o\times Q-U_o)\}, \text{ and}$$

$$[Pi-Ri\times(\alpha_i\times Q+U_o)-R_1\times(Z-1)\times\{(\alpha_1\times Q)/2+U_o/2\}]\geqq[P_o-R_{o1}\times(\alpha_o\times Q-U_o)-R_2\times(Z-1)\times\{(\alpha_o\times Q)/2-U_o/2\}].$$

14 Claims, 17 Drawing Sheets

LIQUID DROPLET EJECTION MECHANISM AND IMAGE FORMING APPARATUS

BACKGROUND OF THE INVENTION

1. Field of the Invention

The present invention relates to a liquid droplet ejection mechanism and an image forming apparatus, and more particularly to a liquid droplet ejection mechanism and an image forming apparatus that can prevent increase in the viscosity of circulated ink and can suppress the amount of ink which is circulated wastefully.

2. Description of the Related Art

International Publication No. WO00/38928 discloses an apparatus which circulates ink in a nozzle section during ink ejection, in order to perform a head cleaning (to remove foreign matter). FIG. 17 is a cross-sectional diagram of a print head 201 disclosed in International Publication No. WO00/38928. The ink which flows out from the first ink tank (not illustrated) flows from a channel 210 into a first column 212 and a second column 213 of a chamber, via an opening section 211. Thereupon, the ink flows out via opening sections 214 and 216 and the ink flow is made to converge by passing along a first ink outlet channel 217 and a second ink outlet channel 218, and is then recovered in a second ink tank (not illustrated). Thereupon, the ink is returned from the second ink tank to the first ink tank and then supplied again to the channel 210, thereby circulating the ink.

Circulating the ink in this way brings about the effect that the chamber is kept clean efficiently and the effect that stagnation of ink in the nozzle sections inside the inkjet head is prevented, so that increase in the viscosity of the ink is prevented.

However, in the invention described in International Publication No. WO00/38928, ink which has exited to the outside of the print head 201 is returned again to the second ink tank and the first ink tank. Here, the ink which has exited to the outside of the inkjet head from the pressure chambers in the head via the nozzles has increased in viscosity due to the evaporation of solvent in the nozzle sections. Therefore, the ink viscosity increases as the ink is circulated, and ejection defects may eventually occur in the nozzles.

In response to this, it would be possible to discard ink which has exited to the outside of the head, rather than returning this ink to the first ink tank, but since the amount of circulated ink is very large, the amount of discarded ink would also become very large, leading to poor efficiency.

Furthermore, it is also possible to add solvent in order to return the ink to its original viscosity, before returning the ink to the first ink tank, but this would require a mechanism for adding the solvent and hence the inkjet recording apparatus becomes very large in size. Moreover, since the amount of solvent to be added varies with the air temperature and humidity, it is not easy to return the ink to its original viscosity.

SUMMARY OF THE INVENTION

Therefore, it is an object of the present invention to provide a liquid droplet ejection mechanism and an image forming apparatus whereby increase in the viscosity of circulated ink is prevented while the volume of ink circulated needlessly is suppressed.

In order to attain the aforementioned object, the present invention is directed to a liquid droplet ejection mechanism comprising: a first ink tank and a second ink tank which store ink; a plurality of ink chamber units which are capable of ejecting the ink; a first common flow channel which connects the first ink tank with the plurality of ink chamber units; and a second common flow channel which connects the second ink tank with the plurality of ink chamber units, wherein: each of the plurality of ink chamber units includes a pressure chamber which supplies the ink to a nozzle capable of ejecting ink, an ink supply channel which connects the first common flow channel and the pressure chamber, and an ink circulation channel which connects the second common flow channel and the pressure chamber; the ink supplied from the first ink tank circulates in such a manner that the ink flows through the first common flow channel, the ink chamber units that do not eject the ink, and the second common flow channel to the second ink tank to be recovered in the second ink tank; the plurality of ink chamber units include a nearest connection ink chamber unit which is connected to the first ink tank at the shortest distance from the first ink tank, of the plurality of ink chamber units, and is also connected to the second ink tank at the shortest distance from the second ink tank, of the plurality of ink chamber units; and taking pressure in the first ink tank to be $P_i$, taking pressure in the second ink tank to be $P_o$, taking volume of the ink circulated per unit time from the first ink tank to the second ink tank when the plurality of ink chamber units do not eject the ink to be $U_o$, taking the ratio between volume of the ink supplied per unit time from the ink supply channel and volume of ink supplied per unit time from the ink circulation channel when the ink is being ejected from at least one of the ink chamber units to be $\alpha_i:\alpha_o$, taking total volume of the ink ejected per unit time from all of the ink chamber units which are ejecting ink to be Q, taking flow channel resistance from a connection section with the first ink tank to a connection section with the nearest connection ink chamber unit in the first common flow channel to be $R_i$, taking the flow channel resistance from a connection section with the second ink tank to a connection section with the nearest connection ink chamber unit in the second common flow channel to be $R_{o1}$, taking flow channel resistance in the first common flow channel between mutually adjacent ink chamber units to be $R_1$, taking the flow channel resistance in the second common flow channel between mutually adjacent ink chamber units to be $R_2$, and taking the total number of ink chamber units to be Z, both following conditions are satisfied: $\{Pi-Ri\times(\alpha_i\times Q+U_o)\}\geqq\{P_o-R_{o1}\times(\alpha_o\times Q-U_o)\}$, and $[Pi-Ri\times(\alpha_i\times Q+U_o)-R_1\times(Z-1)\times\{(\alpha_1\times Q)/2+U_o/2\}]\geqq[P_o-R_{o1}\times(\alpha_o\times Q-U_o)-R_2\times(Z-1)\times\{(\alpha_o\times Q)/2-U_o/2\}]$.

According to this aspect of the present invention, the ink is circulated through flow channels of the ink tanks and the ink chamber units, and the ink is not circulated via the exterior of the liquid droplet ejection mechanism. Therefore, increase in the viscosity of the ink due to circulation of the ink is suppressed and a good state of the ejection from the nozzles can be maintained.

Furthermore, if the first ink tank and the second ink tank are disposed in such a manner that the ink chamber unit connected at the shortest distance to the tanks is the same ink chamber unit, then the pressure at the connection section between the ink chamber unit connecting with the ink tanks at the shortest distance and the first common flow channel is greater than the pressure at the connection section between that ink chamber unit and the second common flow channel. Moreover, the pressure at the connection section between the ink chamber unit connecting with the ink tanks at the furthest distance and the first common flow channel is greater than the pressure at the connection section between that ink chamber unit and the second common flow channel.

Therefore, for all of the ink chamber units in which the ink is not being ejected from the nozzles, the pressure in the portion of the first common flow channel which connects with the ink chamber unit is greater than the pressure in the portion of the second common flow channel which connects with the ink chamber unit. Consequently, there is no reverse flow of the ink and hence no reciprocal movement of the ink in the pressure chambers of any of the ink chamber units in which ink is not being ejected from the nozzles (non-ejecting pressure chambers), and therefore increase in the viscosity of the ink can be suppressed more reliably and a good state of ejection from the nozzles can be maintained.

In this way, in the pressure chambers (non-ejecting pressure chambers) in which ink is not being ejected from the nozzles, ink supplied from the first ink tank via the first common flow channel flows in from the ink supply channel and flows out into the ink circulation channel, whereupon the ink is recovered into the second ink tank via the second common flow channel.

On the other hand, in the pressure chambers (ejecting pressure chambers) where ink is being ejected from the nozzles, the ink supplied from the first ink tank via the first common flow channel flows in through the ink supply channel, and ink supplied from the second ink tank via the second common flow channel flows in a reverse flow through the ink circulation channel. In this case, the ratio between the volume of ink supplied per unit time from the ink supply channel and the volume of ink supplied per unit time from the ink circulation channel is represented as "$\alpha_i:\alpha_o$,".

Here, the "pressure chamber connected to the first ink tank (or second ink tank) at the shortest (or greatest) distance" means the pressure chamber, of the plurality of pressure chambers provided in the head, which is connected at the shortest (or greatest) flow path length from the first ink tank (or second ink tank).

In order to attain the aforementioned object, the present invention is also directed to a liquid droplet ejection mechanism comprising: a first ink tank and a second ink tank which store ink; a plurality of ink chamber units which are capable of ejecting the ink; a first common flow channel which connects the first ink tank with the plurality of ink chamber units; and a second common flow channel which connects the second ink tank with the plurality of ink chamber units, wherein: each of the plurality of ink chamber units includes a pressure chamber which supplies the ink to a nozzle capable of ejecting ink, an ink supply channel which connects the first common flow channel and the pressure chamber, and an ink circulation channel which connects the second common flow channel and the pressure chamber; the ink supplied from the first ink tank circulates in such a manner that the ink flows through the first common flow channel, the ink chamber units that do not eject the ink, and the second common flow channel to the second ink tank to be recovered in the second ink tank; the plurality of ink chamber units include: a furthest connection ink chamber unit which is connected to the first ink tank at the greatest distance from the first ink tank and is connected to the second ink tank at the shortest distance from the second ink tank, of the plurality of ink chamber units; and a nearest connection ink chamber unit which is connected to the first ink tank at the shortest distance from the first ink tank and is connected to the second ink tank at the greatest distance from the second ink tank, of the plurality of ink chamber units; and taking pressure in the first ink tank to be $P_i$, taking pressure in the second ink tank to be $P_o$, taking volume of the ink circulated per unit time from the first ink tank to the second ink tank when the plurality of ink chamber units do not eject the ink to be $U_o$, taking the ratio between volume of the ink supplied per unit time from the ink supply channel and volume of ink supplied per unit time from the ink circulation channel when the ink is being ejected from at least one of the ink chamber units to be $\alpha_i:\alpha_o$, taking total volume of the ink ejected per unit time from all of the ink chamber units which are ejecting ink to be Q, taking flow channel resistance from a connection section with the first ink tank to a connection section with the nearest connection ink chamber unit in the first common flow channel to be $R_i$, taking the total number of ink chamber units to be Z, taking flow channel resistance in the first common flow channel between mutually adjacent ink chamber units to be $R_1$, and taking the flow channel resistance from a connection section with the second ink tank to a connection section with the furthest connection ink chamber unit in the second common flow channel to be $R_{oz}$, a following condition is satisfied: $[Pi-Ri\times(\alpha_i\times Q+U_o)-R_1\times(Z-1)\times\{(\alpha_i\times Q)/2+U_o/2\}]\geqq(P_o-R_{oz}\times(\alpha_o\times Q-U_0)\}$.

According to the present invention, the ink is circulated through flow channels of the ink tanks and the ink chamber units, and the ink is not circulated via the exterior of the liquid droplet ejection mechanism. Therefore, increase in the viscosity of the ink due to circulation of the ink is suppressed and a good state of the ejection from the nozzles can be maintained.

Furthermore, if the second ink tank is disposed in such a manner that the furthest connection ink chamber unit, which is the ink chamber unit connected with the first ink tank at the greatest distance, is connected with the second ink tank at the shortest distance, and in such a manner that the nearest connection ink chamber unit, which is the ink chamber unit connected with the first ink tank at the shortest distance, is connected with the second ink tank at the greatest distance, then in the furthest connection ink chamber unit, the pressure at the connection section with the first common flow channel will be greater than the pressure at the connection section with the second common flow channel. Therefore, the degree to which the pressure at the connection section between each ink chamber unit and the first common flow channel is higher than the pressure at the connection section between each ink chamber unit and the second common flow channel, becomes greater sequentially from the furthest connection ink chamber unit toward the nearest connection ink chamber unit. Therefore, for all the ink chamber units from which ink is not being ejected, the pressure at the connection section with the first common flow channel is greater than the pressure at the connection section with the second common flow channel. Consequently, there is no reverse flow of ink and hence no reciprocal movement of the ink in the pressure chambers of any of the ink chamber units in which ink is not being ejected from the nozzle (non-ejecting pressure chambers), and therefore increase in the viscosity of the ink can be suppressed more reliably and a good state of the ejection from the nozzles can be maintained.

Preferably, the pressure in at least one of the first ink tank and the second ink tank is controlled in such a manner that volume of the ink supplied from the second ink tank when the ink is being ejected becomes equal to volume of the ink circulated from the first ink tank to the second ink tank when the ink is not being ejected.

According to this aspect of the present invention, since the volume of ink supplied from the second ink tank to ink chamber units which are not ejecting ink is equal to the volume of ink recovered to the second ink tank after being supplied from the first ink and circulated, then the volume of ink in the second ink tank does not increase or decrease. Therefore, the ink which is circulated from the first ink tank to the second ink tank as a countermeasure against increase in the ink viscosity can be utilized more efficiently by being used to print onto a print medium by being ejected from the nozzles.

Moreover, since this is carried out by controlling the pressures in the first ink tank and the second ink tank, then it is possible to make the volume of ink supplied from the second ink tank to the pressure chambers and the volume of ink circulated from the first ink tank and recovered into the second ink tank become equal in a more reliable fashion, and beneficial effects are obtained in that there is no increase or decreased in the volume of ink in the second ink tank and the ink which is circulated from the first ink tank to the second ink tank as a countermeasure against increase in the viscosity of the ink is not wasted.

Preferably, the pressure in the second ink tank is controlled according to a liquid head pressure.

According to this aspect of the present invention, the position of the liquid surface in the second ink tank is automatically kept at a constant position, and the ink which is circulated from the first ink tank to the second ink tank as a countermeasure against increase in the viscosity of the ink can be utilized efficiently by being used to print onto a print medium by being ejected from the nozzles. Therefore, a beneficial effect is obtained in that there is no wasteful consumption of ink.

Preferably, the pressure in the first ink tank is controlled according to the liquid head pressure; and taking cross-sectional area of the second ink tank to be $S_2$ and taking cross-sectional area of the first ink tank to be $S_1$, a following condition is satisfied: $S_2<S_1$.

According to this aspect of the present invention, since the cross-sectional area of the second ink tank is made smaller than the cross-sectional area of the first ink tank, then the position of the liquid surface in the second ink tank reacts with greater sensitivity to change in the volume of ink supplied per unit time from the ink tank, in comparison with the position of the liquid surface in the first ink tank. Consequently, the volume of circulated ink rises and falls automatically in response to increase and decrease in the ejection volume, and the position of the liquid surface of the second ink tank can be controlled so as to maintain a constant level, more reliably.

Preferably, the pressure in the first ink tank is controlled at a constant level.

According to this aspect of the present invention, the position of the liquid surface in the second ink tank is automatically maintained at a constant level, regardless of the surface area of the liquid surface in the second ink tank.

Desirably, the liquid droplet ejection mechanism further comprises: a third ink tank which stores ink; a measurement device which measures height of a liquid surface in the second ink tank; and a movement device which moves the ink in the second ink tank to the third ink tank, when it is measured by the measurement device that the height of the liquid surface in the second ink tank exceeds a threshold value.

According to this aspect of the present invention, ink is moved from the second ink tank to the third ink tank if the liquid surface exceeds a reference position, and therefore the position of the liquid surface in the second ink tank is maintained at a constant level.

In order to attain the aforementioned object, the present invention is also directed to an image forming apparatus comprising any of the above-described liquid droplet ejection mechanisms.

According to this aspect of the present invention, it is possible to prevent increase in the viscosity of circulated ink and suppress the volume of ink circulated wastefully.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Overview of Liquid Droplet Ejection Mechanism

Figure 1:
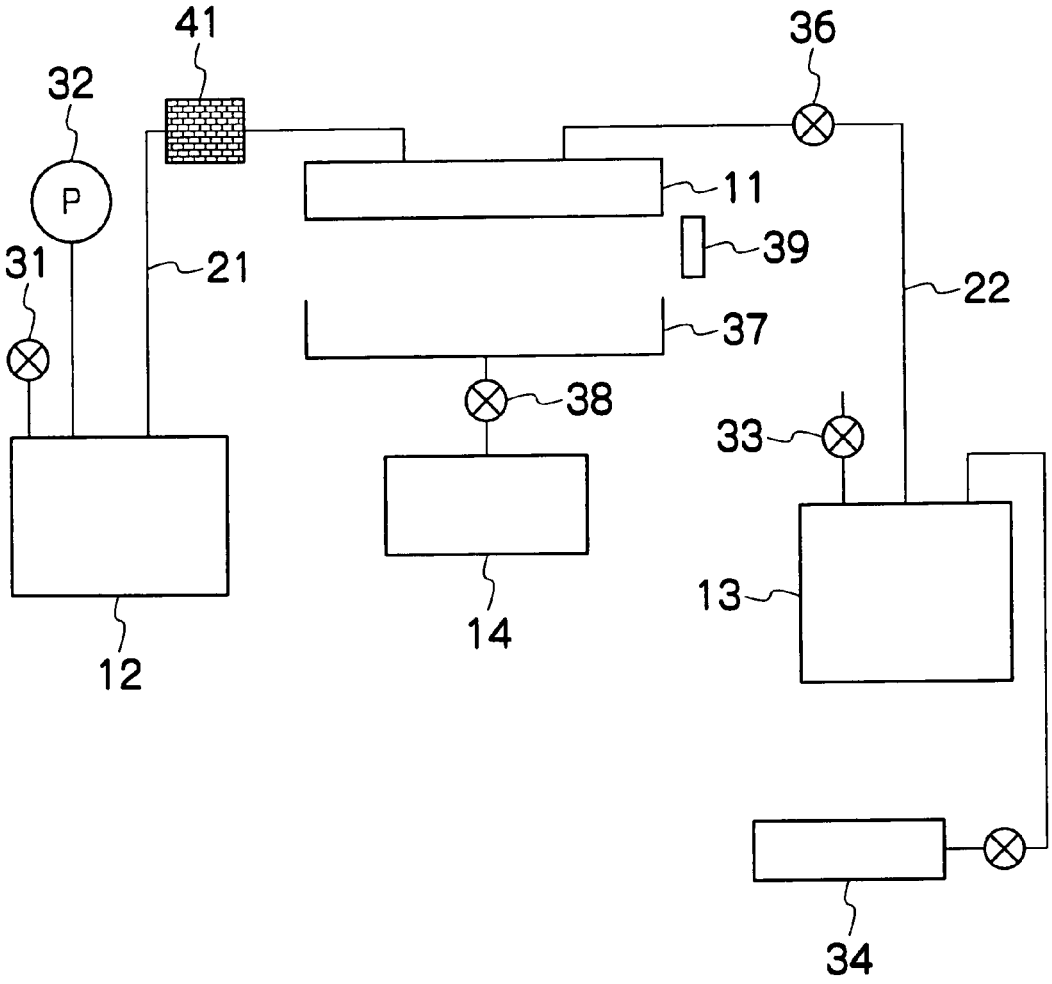
FIG. 1 is a general view of a liquid droplet ejection mechanism according to an embodiment of the present invention.

FIG. 1 is a general view of a liquid droplet ejection mechanism according to an embodiment of the present invention. As shown in FIG. 1, the liquid droplet ejection mechanism according to the present embodiment principally comprises an inkjet head (hereinafter called a "head") 11, a first ink tank 12, a second ink tank 13, a waste ink tank 14, and the like. The head 11 and the first ink tank 12, and the head 11 and the second ink tank 13 are connected by means of a first common flow channel 21 and a second common flow channel 22 respectively. An air connection valve 31, a pressurization pump 32, and the like, are connected to the first ink tank 12. An air connection valve 33, a pressure adjustment device 34, and the like, are connected to the second ink tank 13. A circulation flow channel valve 36 is provided in the flow channel between the head 11 and the second ink tank 13. The waste ink tank 14 is connected to a suction cap member 37 via a cap valve 38, and forms a wiping mechanism in conjunction with a wiping member 39 provided below the nozzle surface of the head 11. A filter 41 is provided in the flow channel between the head 11 and the first ink tank 12.

In the liquid droplet ejection mechanism having this composition, the present embodiment has characteristic features in respect of the structure of the flow channels of the head 11 to which the first ink tank 12 and the second ink tank 13 are connected.

Description of Flow Channel Structure

Figure 2:
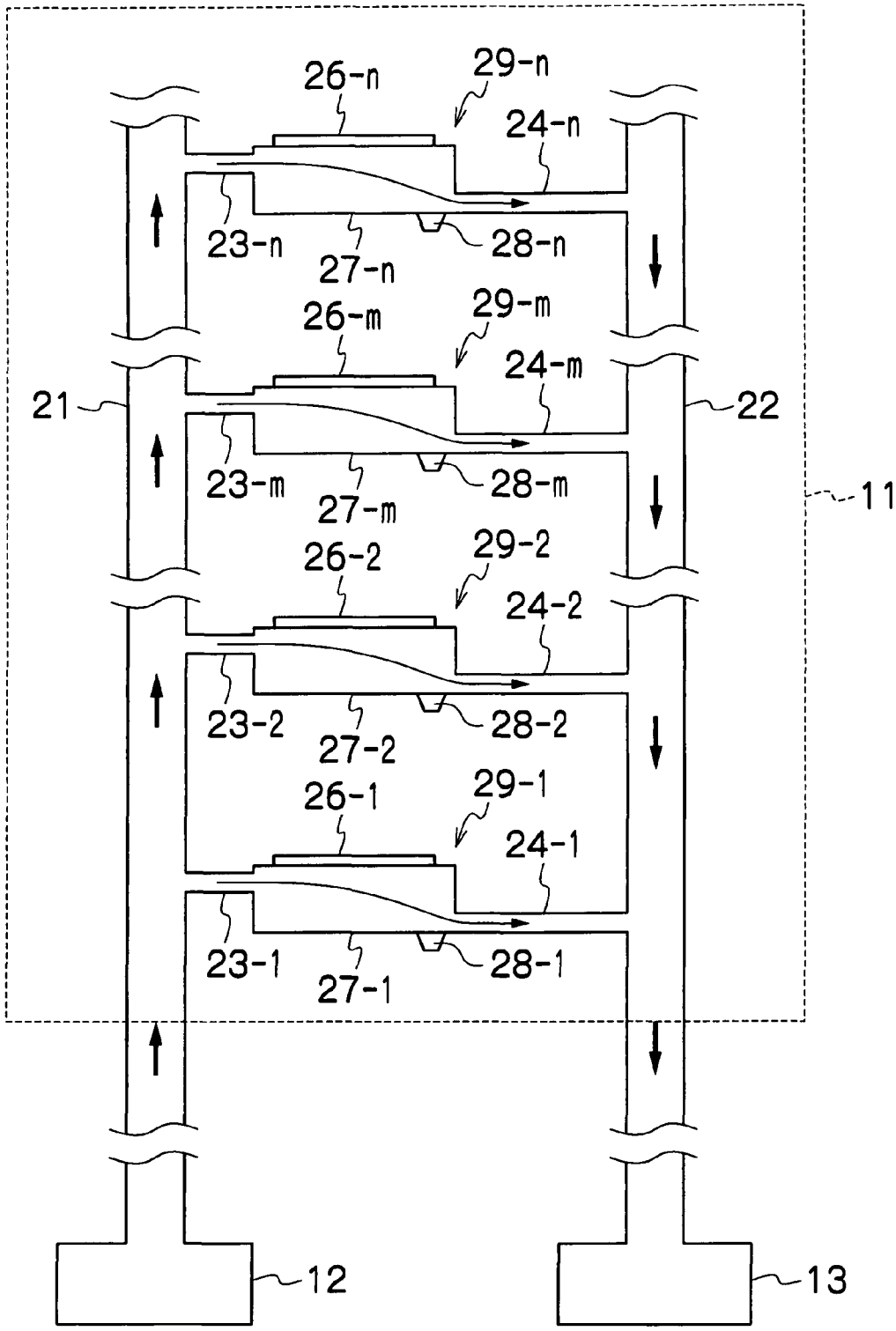
FIG. 2 is a general view of a flow channel structure in the liquid droplet ejection mechanism according to an embodiment of the present invention.

FIG. 2 shows a schematic representation of the composition of the flow channel structure for the head 11, the first ink tank 12 and the second ink tank 13 of the liquid droplet ejection mechanism according to the present embodiment. As shown in FIG. 2, the interior of the head 11 comprises a first common flow channel 21, a second common flow channel 22, and ink chamber units 29. Each of the ink chamber units 29 includes an ink supply channel 23, a piezo (PZT) element 26, a pressure chamber 27, an ink circulation channel 24, a nozzle 28, and the like. In order to simplify the description, the illustration of FIG. 2 shows a certain portion extracted partially from the ink chamber units 29 and numerical suffixes are assigned to each ink chamber unit 29 (for example, pressure chamber 27-1, . . . , **27-*m*, . . . 27-*n*, . . . ). The head 11 is connected to the first ink tank 12 via the first common flow channel 21 and the ink supply channel 23, and it is connected to the second ink tank 13 via the second common flow channel 22 and the ink circulation channel 24**.

FIG. 2 shows a case where no ink is being ejected from the nozzle 28 of any of the pressure chambers (27-1, . . . , m, . . . , n, . . . ), and the ink is circulated normally, from the first ink tank 12 to the second ink tank 13, via the first common flow channel 21, the respective ink supply channels (23-1, . . . , m, . . . , n, . . . ), the respective pressure chambers (27-1, . . . , m, . . . , n, . . . ), the respective ink circulation channels (24-1, . . . , m, . . . , n, . . . ), and the second common flow channel 22. As shown in FIG. 2, in the liquid droplet ejection mechanism according to the present embodiment, ink which has been ejected to the exterior of the head 11 from the nozzles 28 is not re-circulated, but rather ink is circulated within the first ink tank 12, the first common flow channel 21, the ink supply channels 23, the pressure chambers 27, the ink circulation channel 24, the second common flow channel 22, and the second ink tank.

Conditions for Preventing Reverse Flow of Ink

Figure 3:
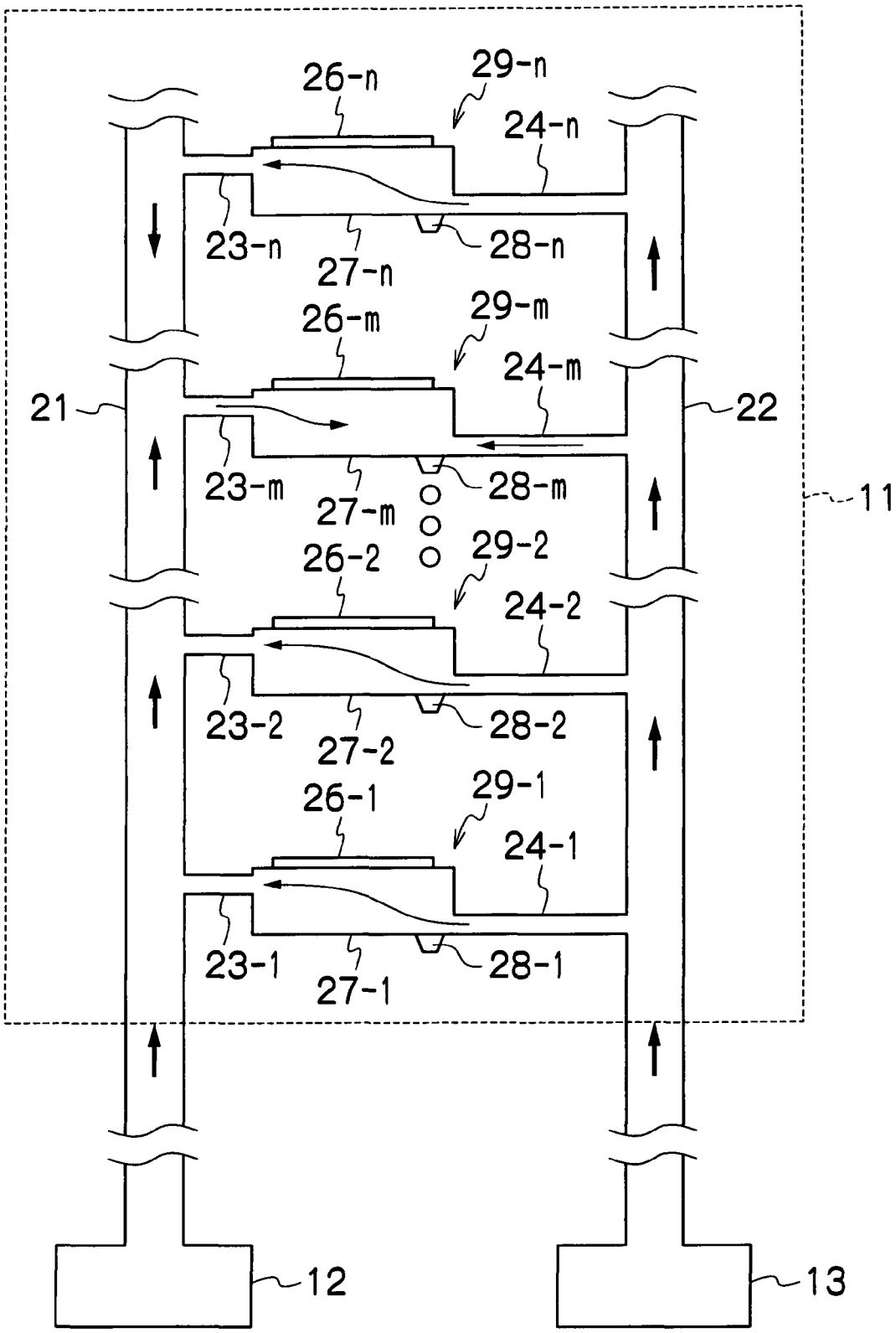
FIG. 3 is a schematic drawing of the flow channel structure in the liquid droplet ejection mechanism according to an embodiment of the present invention, in a case where ink flows in reverse inside non-ejecting pressure chambers, as a result of certain flow channel design conditions.

Here, a case is considered in which ink is ejected from the nozzle **28-*m* for the pressure chamber 27-*m*, as shown in FIG. 3. When ink is ejected from the nozzle 28-*m*, depending on the design of the flow channels, there is a possibility that ink will flow back inside the pressure chambers which are not performing ink ejection (hereinafter, called "non-ejecting pressure chambers") (27-1, 2, n), due to the effects of the ink supplied from the second ink tank 13 to the pressure chamber 27-*m*** which is performing ink ejection.

Figure 4:
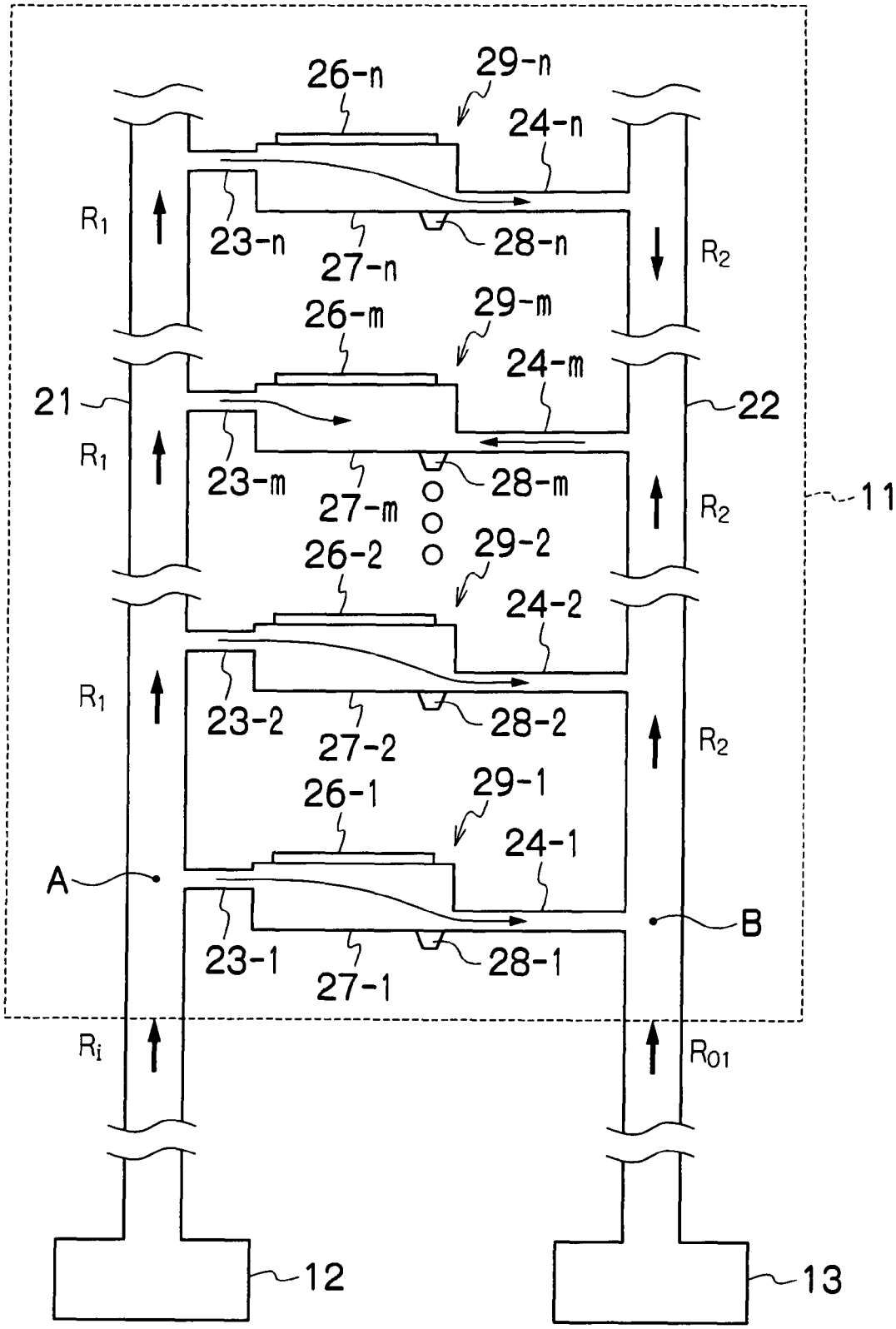
FIG. 4 is a schematic drawing of the flow channel structure in the liquid droplet ejection mechanism according to an embodiment of the present invention, in a case where ink does not flow in reverse inside non-ejecting pressure chambers, as a result of certain flow channel design conditions.

FIG. 4, on the other hand, shows a case where there is no reverse flow of ink inside the non-ejecting pressure chambers (27-1, 2, n). Next, it is explained that the flow channel design conditions which prevent reverse flow of ink inside the non-ejecting pressure chambers (27-1, 2, n), as shown in FIG. 4.

Figure 5:
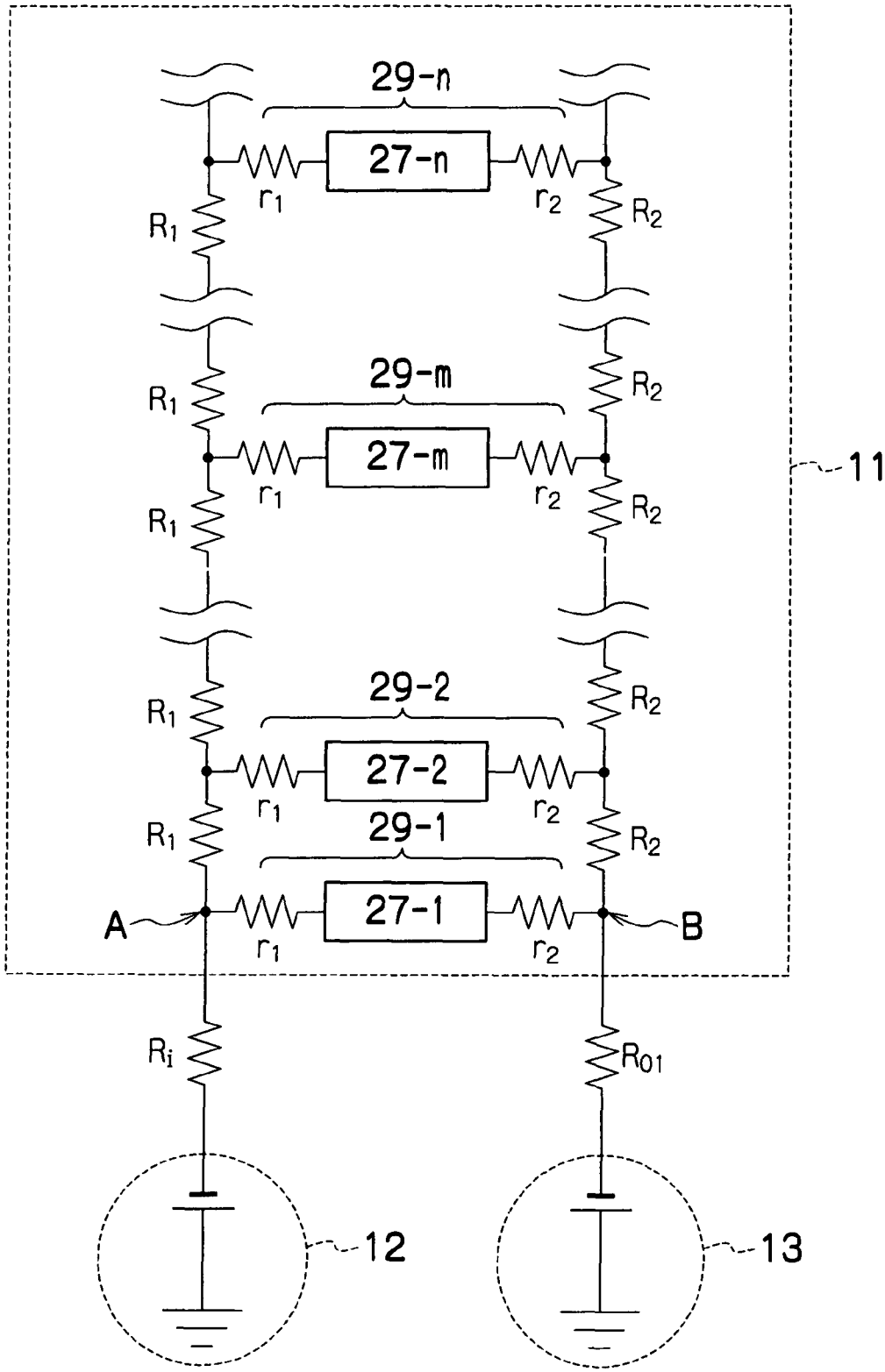
FIG. 5 is an acoustic circuit diagram of a flow channel structure in the liquid droplet ejection mechanism according to an embodiment of the present invention.

The total volume of ink ejected per unit time from all the ink chamber units (**29-*m*, and so on) which are ejecting ink is taken to be Q, and the ratio (refill ratio) between the volume of ink supplied per unit time from the ink supply channel 23 after ink ejection and the volume of ink supplied per unit time from the ink circulation channel 24 after ink ejection is taken to be $\alpha_i:\alpha_o$. Here, $\alpha_i+\alpha_o=1$. Furthermore, the refill ratio is determined on the basis of parameters such as $r_1$ and $r_2$, which are shown in FIG. 5** described below.

Next, the pressures $P_A$ and $P_B$ at point A and point B in FIG. 4 will be considered. As shown in FIG. 4, the ink chamber unit 29-1 is the nearest to the first ink tank 12 and the ink chamber unit 29-1 is also the nearest to the second ink tank 13, and therefore the ink chamber unit 29-1 is common to the first ink tank 12 and the ink chamber unit 29-1 in that sense. Furthermore, as the diagram illustrates, point A in FIG. 4 is the connection point with the ink chamber unit 29-1 in the first common flow channel 21. Similarly, as the diagram illustrates, point B in FIG. 4 is the connection point with the ink chamber unit 29-1 in the second common flow channel 22.

Therefore, taking the pressure of the first ink tank 12 to be $P_i$, taking the pressure of the second ink tank 13 to be $P_o$, taking the volume of ink circulated per unit time from the first ink tank 12 to the second ink tank 13 when no ink is being ejected from the ink chamber unit 29 to be $U_0$, taking the flow channel resistance from the connection section between the first common flow channel 21 and the first ink tank 12 to the connection section between the first common flow channel 21 and the ink chamber unit 29-1 to be $R_i$, and taking the flow channel resistance from the connection section between the second common flow channel 22 and the second ink tank 13 to the connection section between the second common flow channel 22 and the ink chamber unit 29-1 to be $R_{o1}$, then the pressures $P_A$ and $P_B$ can be expressed by the following formula.

$$P_A=P_i-R_i\times(\alpha_i\times Q+U_0) \quad \text{Formula 1}$$

$$P_B=P_o-R_{o1}\times(\alpha_o\times Q-U_0) \quad \text{Formula 2}$$

Here, if the pressures are in such a manner that $P_A \geqq P_B$, then the ink does not flow back from point B toward point A. Therefore, the conditions which prevent reverse flow in the non-ejecting pressure chamber 27-1 can be expressed by the following formula.

$$P_i-R_i\times(\alpha_i\times Q+U_0)\geqq P_o-R_{o1}\times(\alpha_o\times Q-U_0) \quad \text{Formula 3}$$

Next, the pressure losses $\Delta P_1$ and $\Delta P_2$ in the first common flow channel 21 and the second common flow channel 22 will be considered. The flow channel resistance of the first common flow channel 21 between mutually adjacent ink chamber units 29 (for example, between 29-1 and 29-2) is taken to be $R_1$ and the flow channel resistance of the second common flow channel 22 between mutually adjacent ink chamber units 29 (for example, between 29-1 and 29-2) is taken to be $R_2$. The ratio between the volume of ink supplied per unit time from the ink supply channel 23 after ink ejection and the volume of ink supplied per unit time from the ink circulation channel 24 (refill ratio) after ink ejection is $\alpha_i:\alpha_o$, and therefore the respective pressure losses $\Delta P_1$ and $\Delta P_2$ in the first common flow channel 21 and the second common flow channel 22 in FIG. 2, from the ink tank until the most distant pressure chamber 27-*z* (not illustrated), can be represented by the following formulas. FIG. 5 is an acoustic circuit diagram of the flow channel structure in the liquid droplet ejection mechanism according to the present embodiment.

$$\Delta P_1 = R_1 \times (Z-1) \times \left(\frac{\alpha_1 \times Q}{2} + \frac{U_0}{2}\right) \quad \text{Formula 4}$$

$$\Delta P_2 = R_2 \times (Z-1) \times \left(\frac{\alpha_o \times Q}{2} - \frac{U_0}{2}\right) \quad \text{Formula 5}$$

In Formula 4 and Formula 5, the elements are multiplied by ½ because it is considered that the pressure loss is one half of that in a case where all of the ink flows to the endmost pressure chamber. Furthermore, the flow channel resistance is defined as $R_1 \times (Z-1)$, rather than $R_1 \times Z$, because if there are Z pressure chambers, then the number of intervals between the pressure chambers is Z−1.

Here, the condition whereby ink of increased viscosity does not flow back into the non-ejecting pressure chamber 27-*n* is that the pressure losses satisfies the following condition: $(Pi-\Delta P1) \leqq (Po-\Delta P2)$. This can be represented by the following formula.

$$P_i - R_i \times (\alpha_i \times Q + U_0) - R_1 \times (Z-1) \times \left(\frac{\alpha_i \times Q}{2} + \frac{U_0}{2}\right) \geqq P_o - R_{o1} \times (\alpha_o \times Q - U_0) - R_2 \times (Z-1) \times \left(\frac{\alpha_o \times Q}{2} - \frac{U_0}{2}\right) \quad \text{Formula 6}$$

Here, a description will be given using concrete values. If the total number of nozzles 28 in the head 11 is taken to be 400, then taking the average ejection rate to be 10%, it is supposed that ink is being ejected from 40 nozzles 28 (where 40 is the average number of ejecting nozzles, nzl). In this case, the total ejection volume Q of ink per second is $Q=nzl \times f \times q=1.6\times10^{-9}$ $m^3/s$, taking the average number of ejecting nozzles nzl=40, ejection frequency f=20 kHz, and ejection volume q=2 pl. Here, the refill rate $\alpha_i:\alpha_o$, satisfies $\alpha_i=0.7$ and $\alpha_o=0.3$.

The flow channel resistance $R_i$ from the connection section of the first common flow channel 21 with the first ink tank 12 to the connection section of the first common flow channel 21 with the ink chamber unit 29-1 is taken to be $R_i=1\times10^{10}$ $Ns/m^5$, the flow channel resistance $R_{o1}$ from the connection section of the second common flow channel 22 with the second ink tank 13 to the connection section of the second common flow channel 22 with the ink chamber unit 29-1 is $R_{o1}=2\times10^{10}$ $Ns/m^5$, the pressure $P_i$ in the first ink tank 12 is $P_i=-500$ Pa, and the pressure $P_o$ in the second ink tank 13 is $P_o=-700$ Pa.

The flow channel resistance $R_1$ in the first common flow channel 21 between mutually adjacent ink chamber units 29 is $R_1=5\times10^8$ $Ns/m^5$, and the flow channel resistance $R_2$ in the second common flow channel 22 between mutually adjacent ink chamber units 29 is $R_2=1.6\times10^9$ $Ns/m^5$.

Next, the volume of ink circulated in each pressure chamber 27 (nozzle 28) when all of the pressure chambers 27 are non-ejecting pressure chambers under the conditions described above is investigated. Taking the flow channel resistance $r_1$ of the ink supply channel 23 to be $r_1=4.5\times10^{13}$ $Ns/m^5$ and taking the flow channel resistance $r_2$ of the ink circulation channel 24 to be $r_2=1.2\times10^{14}$ $Ns/m^5$, then $r_1+r_2 \approx 1.7\times10^{14}$ $Ns/m^5$. The pressure chambers 27 (nozzles 28) are arranged in a row of 400 nozzles (see FIG. 5). To calculate the combined flow channel resistance r inside the head 11, when $(r_1+r_2) >> R_1$ and $R_2$, then $r=\{(R_1+R_2)\times(r_1+r_2)\}^{1/2}=6.0\times10^{11}$ $Ns/m^5$.

Consequently, the flow channel resistance $R_{all}$ of the overall mechanism is $R_{all}=r+R_i+R_{o1}=6.3\times10^{11}$ $Ns/m^5$. The pressure $P_i$ of the first ink tank 12 is $P_i=-500$ Pa, and the pressure $P_o$ of the second ink tank 13 is $P_o=-700$ Pa, and the pressure differential therebetween is 200 Pa. Therefore, the overall ink circulation volume $U_0$ is $U_0=200$ Pa/$(6.3\times10^{11}$ $Ns/m^5)=3.2\times10^{-10}$ $m^3/s$, and the ink circulation volume per pressure chamber 27 (nozzle 28) is $(3.2\times10^{-10}$ $m^3/s)/400=7.9\times10^{-12}$ $m^3/s=790$ pl/s. This ink circulation volume is a sufficient volume to prevent increase in the viscosity of the meniscus in the region of the nozzle 28. Using the value of $U_0$ thus determined, it is investigated whether or not Formula 3 and Formula 6 are satisfied.

Here, if $U_0$ is substituted into the left-hand side of Formula 3, then $Pi-Ri\times(\alpha_i\times Q+U_0)=-514$ Pa, and if it is substituted into the right-hand side of Formula 3, then $P_o-R_{o1}\times(\alpha_o\times Q-U_0)=-703$ Pa. Therefore, since the left-hand side is greater than the right-hand side, the relationship in Formula 3 is established under the conditions described above.

Furthermore, if substituted into the left-hand side of Formula 6, then $Pi-Ri\times(\alpha_i\times Q+U_o)-R_1\times(Z-1)\times\{(\alpha_i\times Q)/2+U_o/2\}=-666$ Pa, and if substituted into the right-hand side of Formula 6, then $P_o-R_{o1}\times(\alpha_o\times Q-U_o)-R_2\times(Z-1)\times\{(\alpha_o\times Q)/2-U_o/2\}=-754$ Pa. Therefore, since the left-hand side is greater than or equal to the right-hand side, the relationship in Formula 6 is established under the conditions described above.

As described above, under the conditions described above, both Formula 3 and Formula 6 are satisfied, and reverse flow of ink from the non-ejecting pressure chambers (27-1, 2, n) can be prevented.

Figure 6:
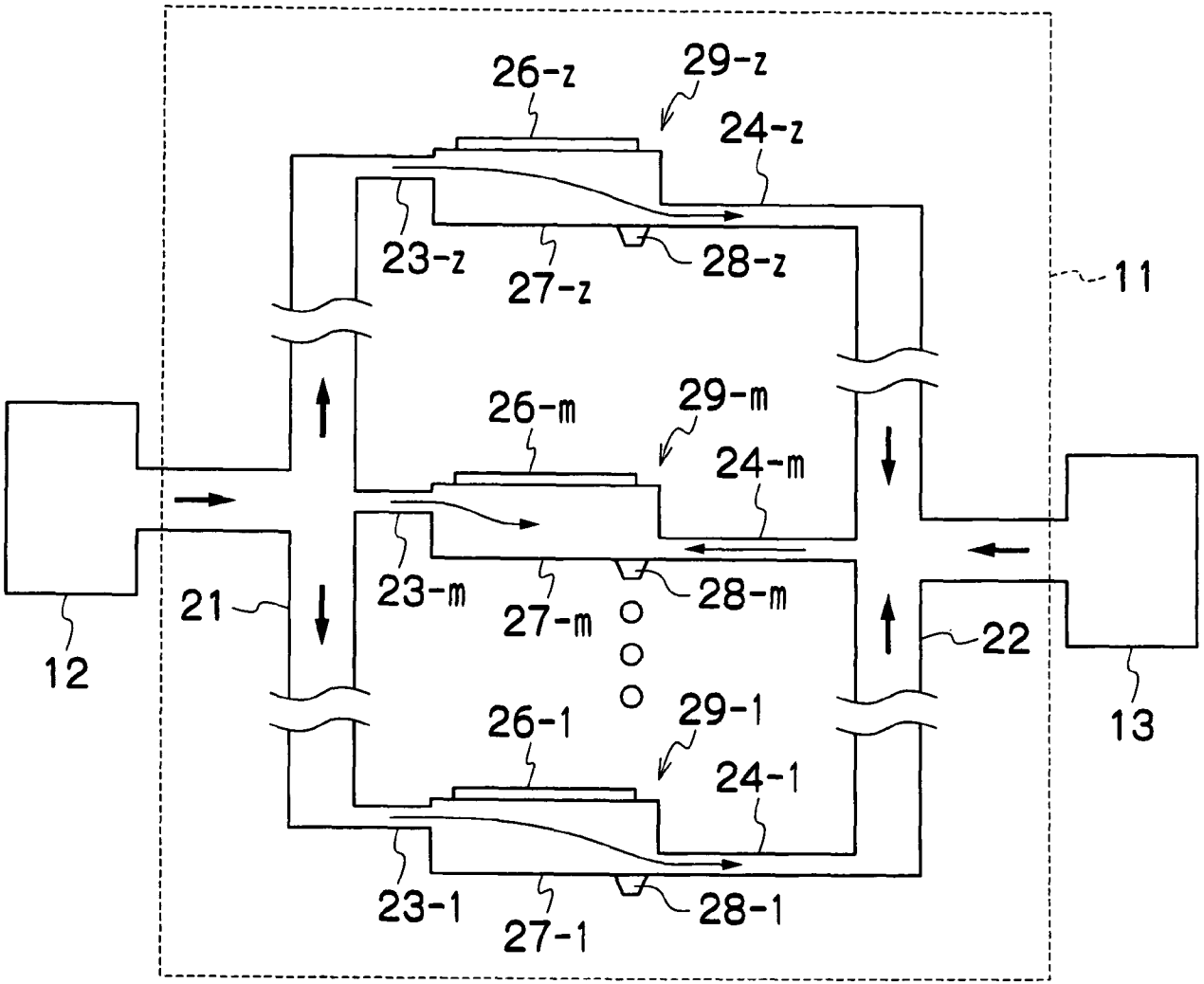
FIG. 6 is a schematic drawing of a further flow channel structure in the liquid droplet ejection mechanism according to an embodiment of the present invention.

Even in a case where the first ink tank 12 and the second ink tank 13 are disposed as shown in FIG. 6, since the pressure chamber 27-*m* nearest to the first ink tank 12 and the second ink tank 13 is the same pressure chamber, then the conditions which prevent reverse flow of ink in the non-ejecting pressure chambers (27-1, z) can be expressed by Formula 3 and Formula 6.

Figure 7:
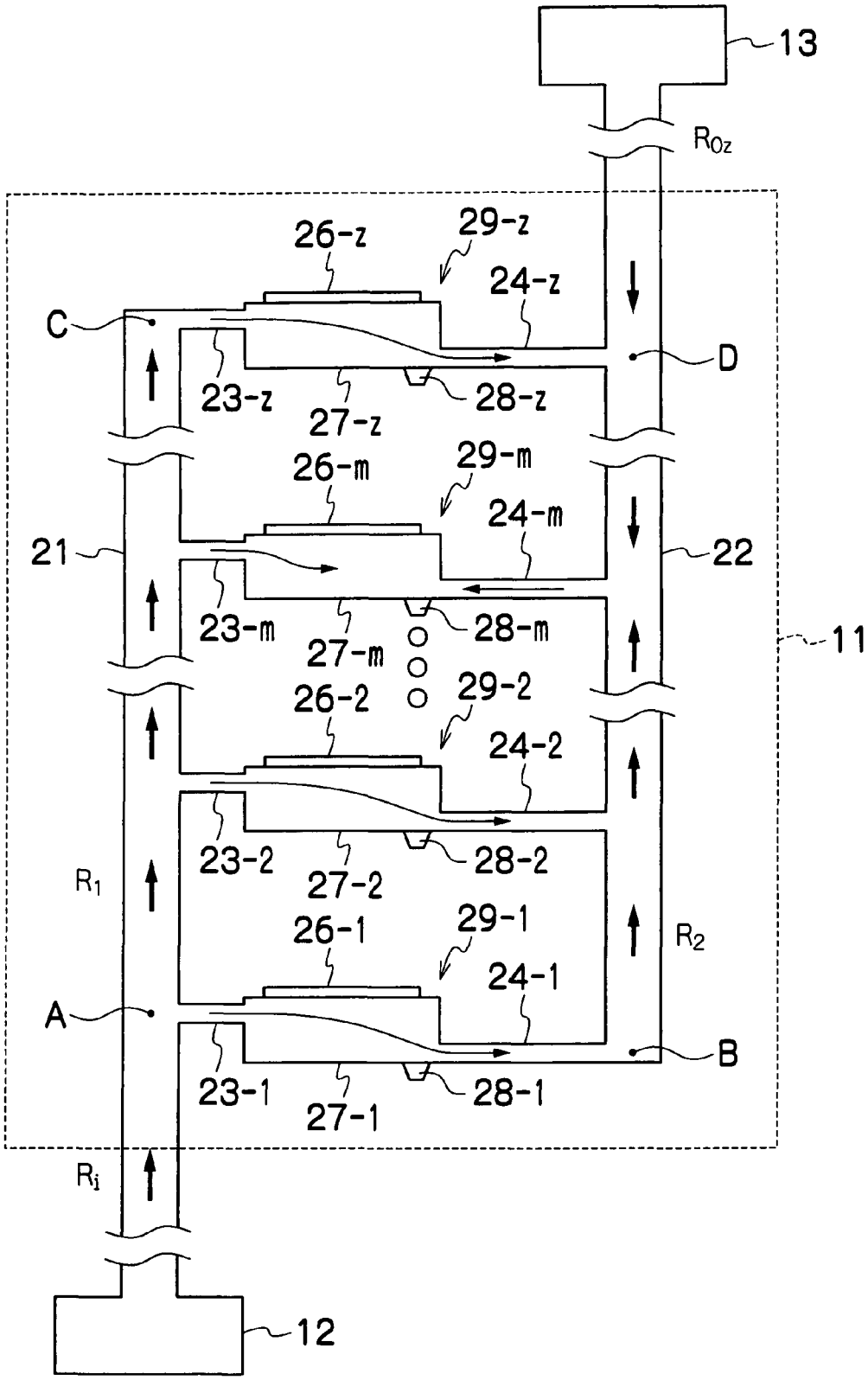
FIG. 7 is a schematic drawing of a further flow channel structure in the liquid droplet ejection mechanism according to an embodiment of the present invention.

Thereupon, investigation is carried out into the flow channel design conditions which prevent reverse flow of ink inside the non-ejecting pressure chambers (27-1, 2, z), in FIG. 7. Firstly, in FIG. 7, the pressure chamber where there is the greatest possibility of reverse flow of ink is the pressure chamber 27-*z*, which is the furthest from the first ink tank and the nearest to the second ink tank. The reason for this is that the pressure in the first common flow channel 21 is more liable to become low at this position. Therefore, if there is no reverse flow of ink in the pressure chamber 27-*z*, which is furthest from the first ink tank 12, it can be considered that there is no reverse flow of ink in the other non-ejecting pressure chambers (27-1, . . . ) either. Consequently, the conditions whereby reverse flow of ink is prevented in the pressure chamber 27-*z* which is furthest from the first ink tank 12 are investigated.

Here, the pressures $P_C$ and $P_D$ at point C and point D in FIG. 7 will be considered. As the diagram illustrates, point C in FIG. 7 is the connection point of the first common flow channel 21 with the ink chamber unit 29-*z*, which is furthest from the first ink tank 12. Similarly, as the diagram illustrates, point D in FIG. 7 is the connection point of the second common flow channel 22 with the ink chamber unit 29-*z*, which is nearest to the second ink tank 13.

Therefore, firstly, taking the pressure in the first common flow channel 21 at point A to be $P_A$, taking the ratio (refill ratio) between the volume of ink supplied per unit time from the ink supply channel 23 after ink ejection and the volume of ink supplied per unit time from the ink circulation channel 24 after ink ejection to be $\alpha_i:\alpha_o$, taking the number of ink chamber units 29-*z* present between point A and point C to be Z, taking the flow channel resistance in the first common flow channel 21 between mutually adjacent ink chamber units 29 to be $R_1$, and taking the pressure loss from point A to point C to be $\Delta P_{AC}$, then $\Delta P_{AC}$ can be expressed as indicated below.

$$\Delta P_{AC} = R_1 \times (Z-1) \times \left(\frac{\alpha_i \times Q}{2} + \frac{U_0}{2}\right) \quad \text{Formula 7}$$

In Formula 7, the elements are multiplied by ½ because it is considered that the pressure loss is one half of that in a case where all of the ink flows to point C.

Thereupon, taking the pressure of the first ink tank 12 to be $P_i$, taking the pressure of the second ink tank 13 to be $P_o$, taking the volume of ink circulated per unit time from the first ink tank 12 to the second ink tank 13 when no ink is being ejected from the ink chamber unit 29 to be $U_0$, taking the flow channel resistance from the connection section of the first common flow channel 21 with the first ink tank 12 to the connection section of the first common flow channel 21 with the ink chamber unit 29-1 to be $R_i$, taking the flow channel resistance from the connection section of the second common flow channel 22 with the second ink tank 13 to the connection section of the second common flow channel 22 with the ink chamber unit 29-*z* to be $R_{oz}$, and taking the pressure at point A in the first common flow channel 21 to be $P_A$, then the pressure $P_C$ at point C can be expressed by the following formula.

$$P_C = P_A - \Delta P_{AC} \quad \text{Formula 8}$$

The expression in Formula 1 can be used directly for the pressure $P_A$ of the first common flow channel 21 at point A, and therefore by substituting the expressions in Formula 1 and Formula 7, it is possible to express the pressure $P_C$ at point C by means of the formula indicated below.

$$P_C = P_i - R_i \times (\alpha_i \times Q + U_0) - R_1 \times (Z-1) \times \left(\frac{\alpha_i \times Q}{2} + \frac{U_0}{2}\right) \quad \text{Formula 9}$$

Furthermore, since the pressure $P_D$ at point D can be considered in a similar fashion to Formula 2, then the following expression can be obtained.

$$P_D = P_o - R_{oz} \times (\alpha_o \times Q - U_0) \quad \text{Formula 10}$$

Here, if $P_C \geqq P_D$, then ink does not flow in reverse in the non-ejecting pressure chamber 27-*z*. Therefore, if there is no reverse flow of ink in the non-ejecting pressure chamber 27-*z*, then it can be considered that there is no reverse flow of ink in any of the non-ejecting pressure chambers (27-1, . . . ).

Consequently, the conditions which prevent reverse flow in the non-ejecting pressure chambers (27-1, 2, z) can be expressed by the following expression, on the basis of Formula 9 and Formula 10.

$$P_i - R_i \times (\alpha_i \times Q + U_0) - R_1 \times (Z-1) \times \left(\frac{\alpha_i \times Q}{2} + \frac{U_0}{2}\right) \geqq P_o - R_{oz} \times (\alpha_o \times Q - U_0) \quad \text{Formula 11}$$

Here, a description will be given using concrete values. It is assumed that there is no change from the numerical values of the conditions used when investigating Formula 3 and Formula 6 above. Strictly speaking, there is a change in the combined resistance r of the head, but since the resistance only rises very slightly, this change can be ignored. Furthermore, if values are substituted into the left-hand side of Formula 11, then $Pi - Ri \times (\alpha_i \times Q + U_o) - R_1 \times (Z-1) \times \{(\alpha_i \times Q)/2 + U_o/2\} = -666$ Pa, and if values substituted into the right-hand side of Formula 11, then $P_o - R_{oz} \times (\alpha_o \times Q - U_o) = -703$ Pa. In this way, under the conditions described above, the relationship indicated in Formula 11 is established.

Method for Eliminating Wasteful Consumption of Ink

There follows a description of a control method for keeping the volume of ink in the second ink tank 13 constant during printing, in order to achieve a stable state of the ejection from the nozzles 28 and to eliminate wasteful consumption of ink, on the basis of the conditions for preventing reverse flow of ink described above.

Here, firstly, consideration is given to how the volume of ink inside the second ink tank 13 changes due to ejection of ink from the nozzles 28 which are connected directly to the pressure chambers 27. In this, consideration is given to the relationship between the volume of ink supplied per unit time from the second ink tank 13 to the pressure chambers 27 and the volume of ink circulated per unit time and recovered into the second ink tank 13, in the process of supplying ink from the second ink tank 13 to the pressure chambers 27 in order to eject ink from the nozzles 28.

Firstly, if the volume of ink supplied per unit time from the second ink tank 13 to the pressure chambers 27 is greater than the volume of ink circulated per unit time and recovered into the second ink tank 13, then the ink volume in the second ink tank 13 gradually decreases. Therefore, if printing is carried out continuously for a long period of time and the second ink tank becomes empty, then there is a possibility that ink will not be supplied from the second ink tank to the pressure chambers 27, thus affecting the ink ejection volume from the nozzles 28, and a stable ejection state from the nozzles 28 cannot be achieved. Consequently, if it is wished to carry out printing continuously for a long period of time, then it is necessary to halt the operation of the inkjet recording apparatus and to supply ink to the second ink tank 13.

On the other hand, if the volume of ink supplied per unit time from the second ink tank 13 to the pressure chambers 27 is lower than the volume of ink circulated per unit time and recovered into the second ink tank 13, then the ink volume in the second ink tank 13 gradually increases. Consequently, ink which has not been used for printing gradually accumulates in the second ink tank. Therefore, the amount of circulated ink becomes excessive and ink is consumed wastefully.

From the foregoing, in order to achieve a stable ejection state from the nozzles 28 and suppress the volume of ink consumed wastefully, it is necessary that the volume of ink supplied per unit time from the second ink tank 13 to the pressure chambers 27 be equal to the volume of ink circulated per unit time and recovered into the second ink tank 13.

Therefore, the volume of ink supplied from the second ink tank 13 and the volume of ink circulated and recovered into the second ink tank 13 are made to be equal by altering the pressure $P_o$ in the second ink tank 13. More specifically, the volume of ink supplied from the second ink tank 13 and the volume of ink circulated and recovered to the second ink tank 13 are made equal by altering the pressure $P_o$ of the second ink tank 13 so as to adjust the pressure differential between the first ink tank 12 and the second ink tank 13, and thereby adjusting the volume of ink supplied from the second ink tank 13.

A concrete example is described below using numerical values. The ejection rate, which is found by dividing the number of pressure chambers (nozzles) serving for ink ejection by the total number of pressure chambers (nozzles), is taken to be 10%, the ejection frequency is taken to be 20 kHz, and the ejection volume per ejection is taken to be 2 pl. In this case, the average ejection volume per second in each pressure chamber is $0.1\times2\times10^4\times2=4000$ pl/s.

Next, the ratio (refill ratio) between the volume of ink supplied per unit time from the ink supply channel 23 and the volume of ink supplied per unit time from the ink circulation channel 24 is taken to be $\alpha_i:\alpha_o=0.7:0.3$ ($\alpha_i+\alpha_o=1$). In this case, the volume of ink supplied from the second ink tank 13 per second is $4000\times0.3=1200$ pl/s. Here, if the volume of ink circulated per unit time and recovered into the second ink tank 13 when ink is not being ejected is 790 pl/s, as determined on the basis of Formula 3 and Formula 6, then the ink in the second ink tank 13 decreases at a rate of 410 pl/s per second.

In this case, if the pressure $P_i$ of the first ink tank 12 is $P_i=-500$ Pa, and the pressure $P_o$ of the second ink tank 13 is $P_o=-700$ Pa, then the pressure differential P between the first ink tank 12 and the second ink tank 13 will be $P=P_i-P_o=(-500)-(-700)=200$ Pa.

Therefore, the ratio of the volume of circulated ink with respect to the volume of supplied ink is 1200/790=1.52. The volume of circulated ink is directly proportional to the pressure differential between the first ink tank 12 and the second ink tank 13, and therefore the pressure differential P between the first ink tank 12 and the second ink tank 13 should be a factor of 1.52. Consequently, if the new pressure value of the second ink tank 13 is taken to be $P_o'=P_i-(P_i-P_o)\times1.52=(-500)-200\times1.52=-804$ Pa, then it is possible to make the amount of circulated ink equal to the amount of supplied ink.

The ratio (refill ratio) $\alpha_i:\alpha_o$ between the volume of ink supplied per unit time from the ink supply channel 23 and the volume of ink supplied per unit time from the ink circulation channel 24 may vary with the amount of ink ejected from the nozzles 28, but in the present embodiment, a case is considered in which the amount of ink ejected from the nozzles 28 is sufficiently small.

Furthermore, the average ejection volume per second in one pressure chamber can be calculated from the data relating to the print object. The volume of circulated ink can be adjusted by controlling the pressure differential between the first ink tank 12 and the second ink tank 13, in accordance with this average ejection volume.

For example, the volume of ink supplied per second from the second ink tank 13 when the average ejection rate is 20% is two times the volume when the average ejection rate is 10%, namely, 2320 pl/s. Therefore, in order that the volume of ink circulated and recovered into the second ink tank 13 per second is taken to be 2320 pl/s, the pressure differential P between the first ink tank 12 and the second ink tank 13 should be set to $P=(2320/1100)\times200=422$ Pa. Consequently, the pressure inside the second ink tank should be controlled in such a manner that $P_o$ becomes $P_o=-922$ Pa with respect to the $P_i$ value of $P_i=-500$ Pa.

An example has been described in which the pressure inside the second ink tank is controlled, but it is also possible to control the pressure inside the first ink tank.

Next, the method for applying pressure to the second ink tank 13 will be described. Desirably, pressure in the second ink tank 13 is adjusted on the basis of the liquid head differential with respect to the first ink tank 12. Below, the reasons for this are described with reference to different cases.

Firstly, a case is considered in which the volume of ink ejected from the nozzles 28 has increased, the volume supplied from the second ink tank 13 has increased, and the surface of the ink in the second ink tank 13 has fallen. As a result of the decrease in the ink volume in the second ink tank 13 and the fall in the liquid surface, the pressure $P_o$ in the second ink tank 13 declines. When the pressure $P_o$ of the second ink tank 13 declines, then since the volume of circulated ink is directly proportional to the pressure differential between the first ink tank 12 and the second ink tank 13, the volume of circulated ink increases. If the volume of circulated ink increases, then the ink in the second ink tank 13 tends to increase.

Now, a case is considered where, conversely, the ink ejection volume from the nozzles 28 decreases, and hence the supply volume from the second ink tank 13 decreases and the ink surface rises. In this case, if a pressure is applied to the second ink tank 13 on the basis of the liquid head differential with respect to the first ink tank 12, then the volume supplied from the second ink tank 13 decreases, the volume of ink in the second ink tank 13 increases, and the liquid surface in the second ink tank 13 rises. As a result of this, the pressure $P_o$ in the second ink tank 13 increases. When the pressure $P_o$ of the second ink tank 13 increases, then since the volume of circulated ink is directly proportional to the pressure differential between the first ink tank 12 and the second ink tank 13, the volume of circulated ink decreases. If the volume of circulated ink decreases, then the ink in the second ink tank 13 tends to decrease.

Accordingly, it can be seen that in both of the cases described above, the ink volume in the second ink tank 13 tends to remain at a constant rate. Consequently, the ink volume in the second ink tank 13 is kept to a constant volume, and a beneficial effect is obtained in that wasteful consumption of ink due to circulation of ink is eliminated.

Here, if the pressure of the first ink tank 12 is also controlled by means of the liquid head differential, then there is a possibility that the liquid surface of the first ink tank 12 may also fall if the ejection volume increases. The reason for this is that, if the liquid surface of the first ink tank 12 falls below the liquid surface of the second ink tank 13, then the pressure $P_i$ of the first ink tank 12 falls below that of the second ink tank $P_o$, and hence the pressure differential ($P_i-P_o$) between the two tanks declines. As a result of this, the amount of circulated ink decreases and the amount of ink in the second ink tank 13 decreases further.

Therefore, the cross-sectional area $S_1$ of the first ink tank 12 should be set to a larger area than the cross-sectional area $S_2$ of the second ink tank 13 (in other words, $S_1>S_2$). By this means, the liquid surface in the second ink tank 13 is made to react with greater sensitivity to change in the ejection volume, compared to the liquid surface of the first ink tank 12. Therefore, as described above, it is possible to control the liquid surface of the second ink tank 13 so as to maintain a constant level.

Figure 8:
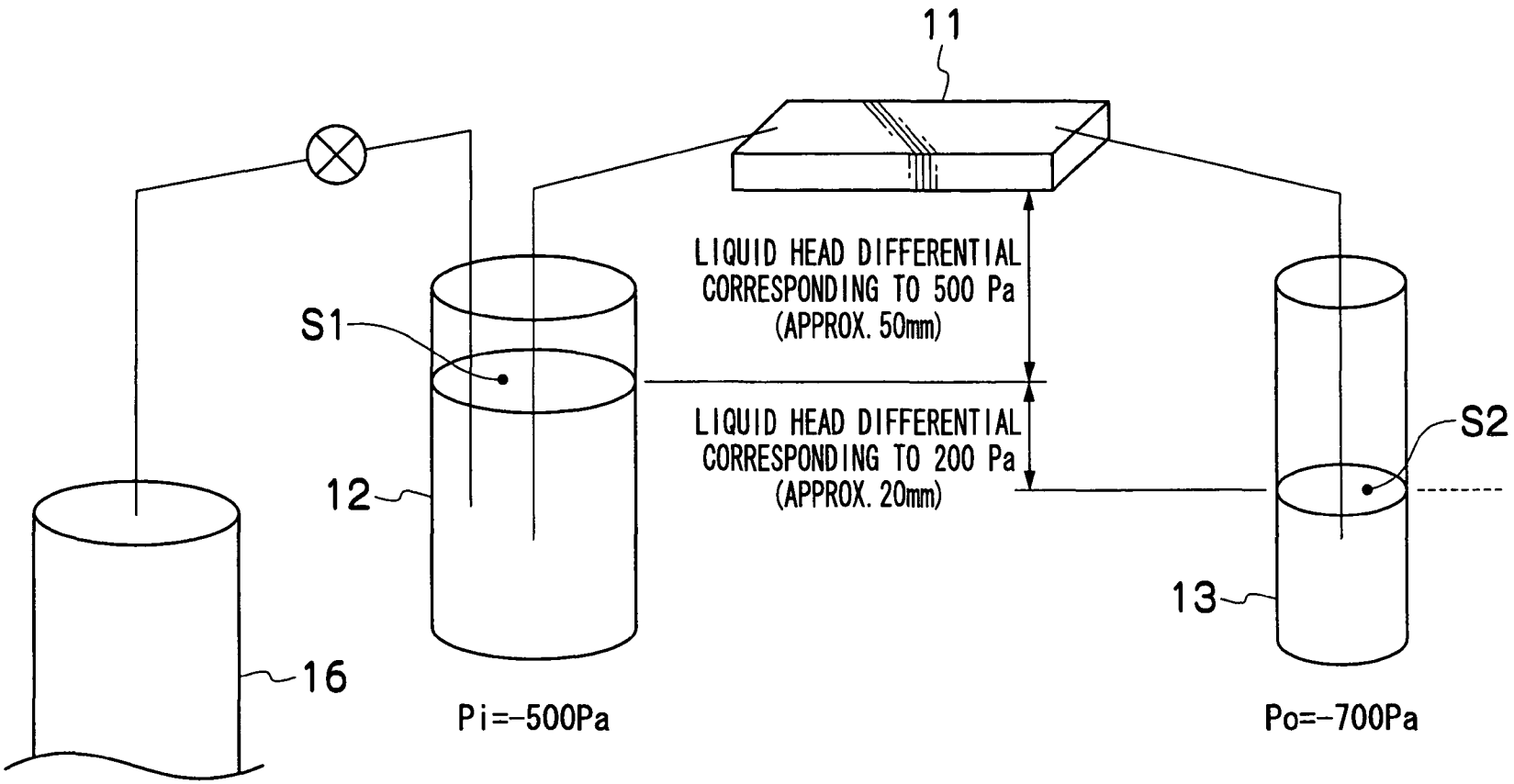
FIG. 8 is a diagram showing an example where the pressure inside the ink tank is controlled by means of the liquid head pressure.

Furthermore, in order to make the change in the liquid surface of the first ink tank 12 smaller than the change in the liquid surface of the second ink tank 13, as a separate solution, it is also possible to control the pressure of the first ink tank 12 so as to maintain a constant pressure. To give a more specific example, as shown in FIG. 8, it is considered that ink is supplied continuously from a main ink tank 16 in such a manner that the liquid surface of the first ink tank 12 remains constant. Furthermore, it is considered that the liquid head pressure is kept to a constant pressure by raising or lowering the first ink tank 12 itself. Moreover, it is also possible to implement control by using a thin film.

However, even if the liquid surface of the second ink tank 13 is controlled by means of the liquid head differential at a constant level, if the liquid droplet ejection head 11 remains in a state of not performing ejection for a certain time, then the liquid surface of the second ink tank 13 rises. For example, this may occur when the power is switched on and a system which circulates the ink continuously is activated.

If the volume of ink inside the second ink tank 13 increases, then there is a possibility that the ink may overflow from the second ink tank. Hence, there follows a description of a mechanism which prevents overflow of ink from the second ink tank 13 in cases where the pressure in the second ink tank 13 is controlled by means of the liquid head differential.

If the pressure Po_max at the height at which the ink overflows from the second ink tank 13 is greater than the maximum value Pi_max of the pressure which can be assumed by the first ink tank 12, then ink circulation is halted automatically before the ink overflows from the second ink tank 13. By setting this relationship (Po_max>Pi_max), it is possible to eliminate the possibility of overflow of ink from the second ink tank 13.

Figure 9:
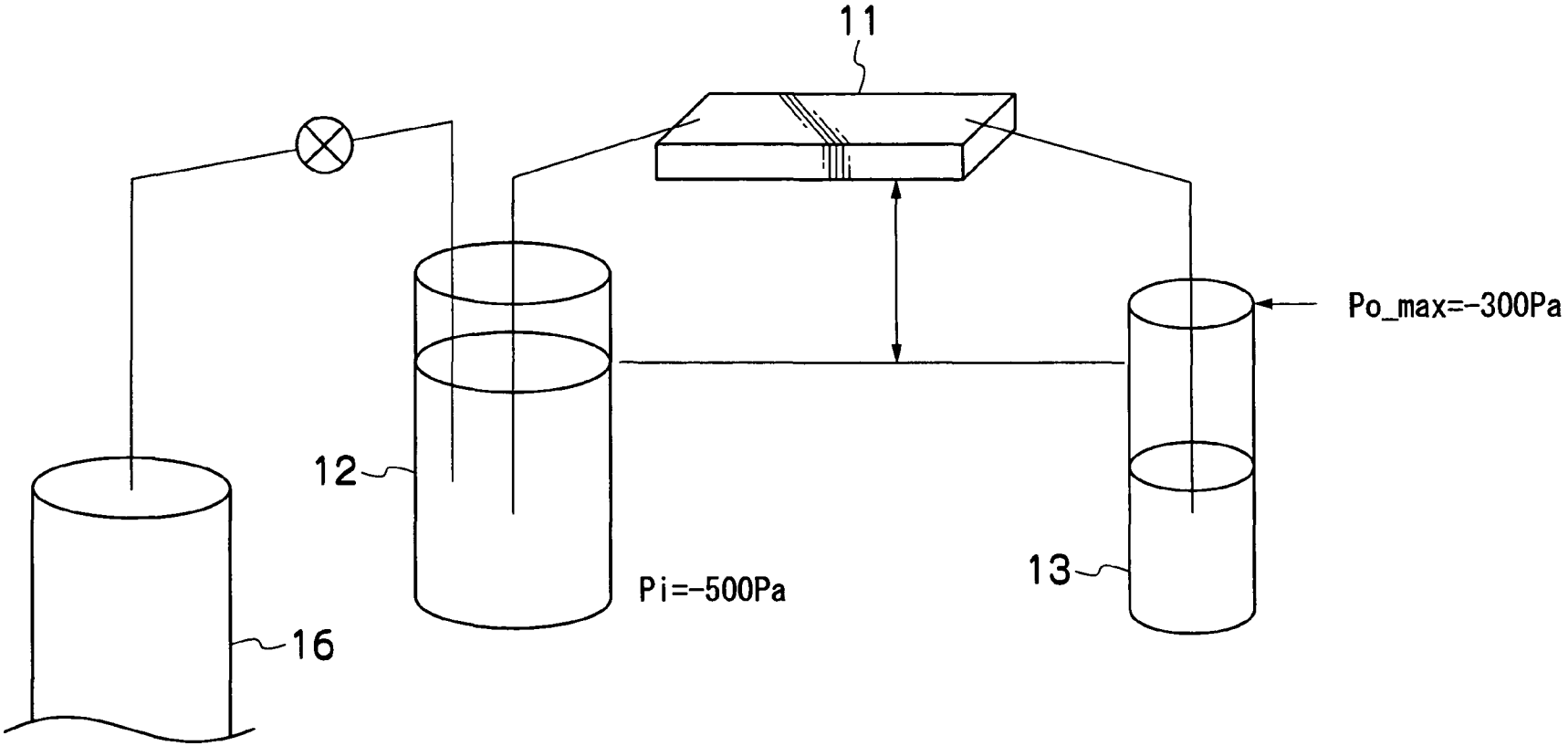
FIG. 9 is an illustrative diagram of a mechanism for preventing overflow of ink from the second ink tank, in cases where the pressure inside the second ink tank is controlled by means of the liquid head differential.

Next, one example is described with reference to FIG. 9. For example, supposing that control is implemented to prevent change in the liquid head differential of the first ink tank 12, the pressure is set to a constant value of $P_i$=−500 Pa, for example. Furthermore, the limit pressure at which the ink overflows from the second ink tank 13 is set to be Po_max=−300 Pa, for example. In this way, the size and the shape of the first ink tank 12 and the second ink tank 13 are specified in such a manner that the relationship $P_i$>Po_max is established. By this means, even if the liquid surface of the second ink tank 13 rises, the circulation of ink halts automatically when the liquid surface reaches the same height as the liquid surface of the first ink tank 12, and therefore it is possible to eliminate the possibility of overflow of ink from the second ink tank 13.

Figure 10:
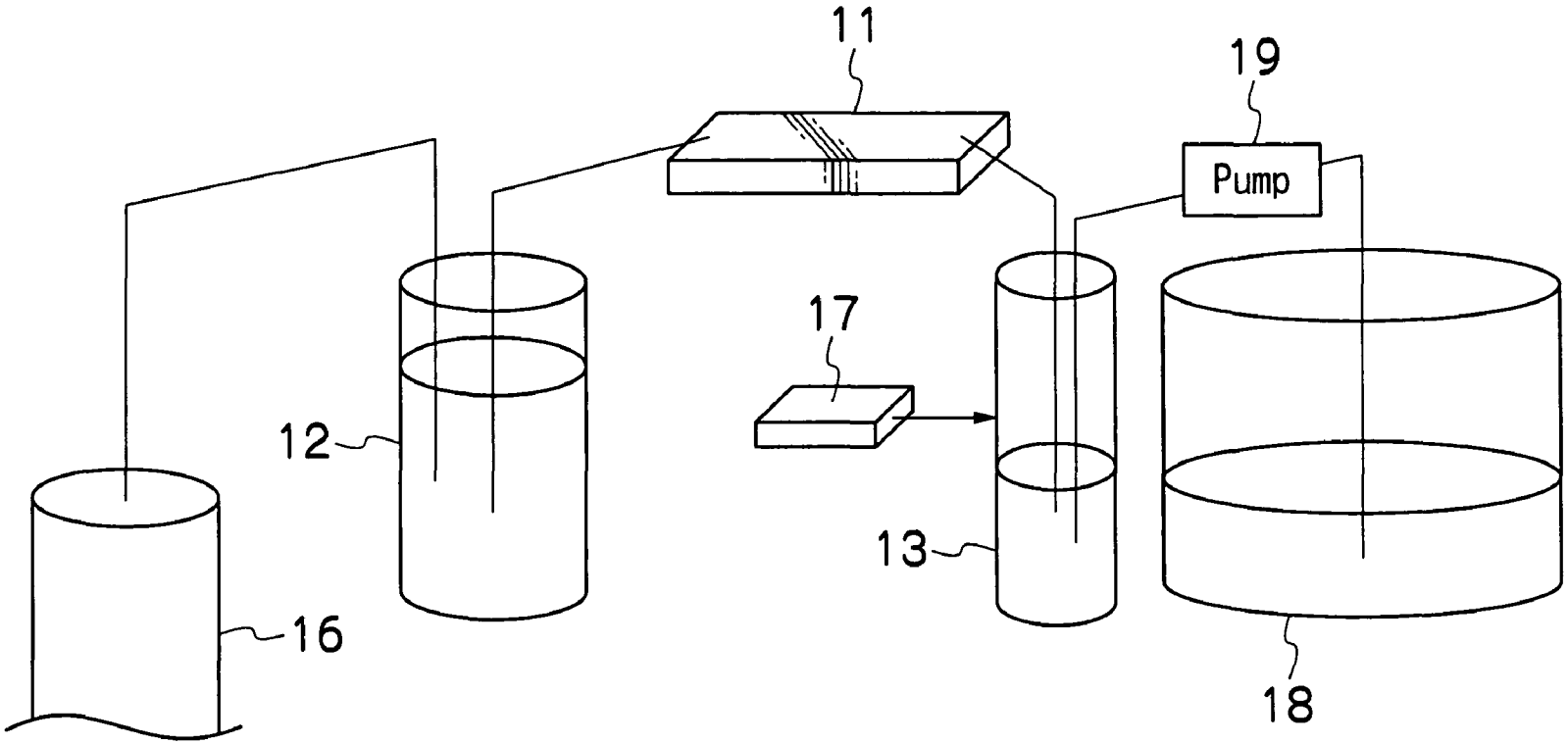
FIG. 10 is an illustrative diagram of a further mechanism for preventing overflow of ink from the second ink tank, in cases where the pressure inside the second ink tank is controlled by means of the liquid head differential.

Another example is described in FIG. 10. As shown in FIG. 10, a liquid surface control sensor 17 is provided with the second ink tank 13, and furthermore, a third ink tank 18 which is connected to the flow channel via the second ink tank 13 and the pump 19 is also provided. In this example, a method is employed which transfers ink to the third ink tank 18 when the ink surface exceeds a certain position. The reference liquid surface at which ink is moved from the second ink tank 13 to the third ink tank 18 may have the height where the liquid surface is equal to that of the first ink tank 12. If the liquid surface of the second ink tank 13 rises and is determined by the liquid surface control sensor 17, then the pump 19 is driven by means of a signal from the liquid surface control sensor 17, and the ink is moved to the third ink tank 18.

If the ejection volume from the head 11 is high and the liquid surface in the second ink tank 13 has fallen, then the ink accumulated in the third ink tank 18 is transferred to the second ink tank 13 by driving the pump 19, and is then ejected from the head 11 onto the print medium. Consequently, it is possible to eliminate the possibility of overflow of ink from the second ink tank 13.

By using the method described above, it is possible to expel all of the ink recovered by ink circulation efficiently onto the print medium, and therefore the occurrence of wasted ink is eliminated.

In the example described above, it is supposed that both of the pressures $P_i$ and $P_o$ are lower than atmospheric pressure, but these pressure values are not limited in particular to this. Provided that the condition $P_i$>$P_o$ is satisfied, then it does not matter whether $P_i$ and $P_o$ are higher or lower than atmospheric pressure.

Composition of Inkjet Recording Apparatus

Next, an inkjet recording apparatus is described as a concrete example of the application of an image recording apparatus comprising the liquid droplet ejection mechanism constituted by the head flow channel structure described above.

Figure 11:
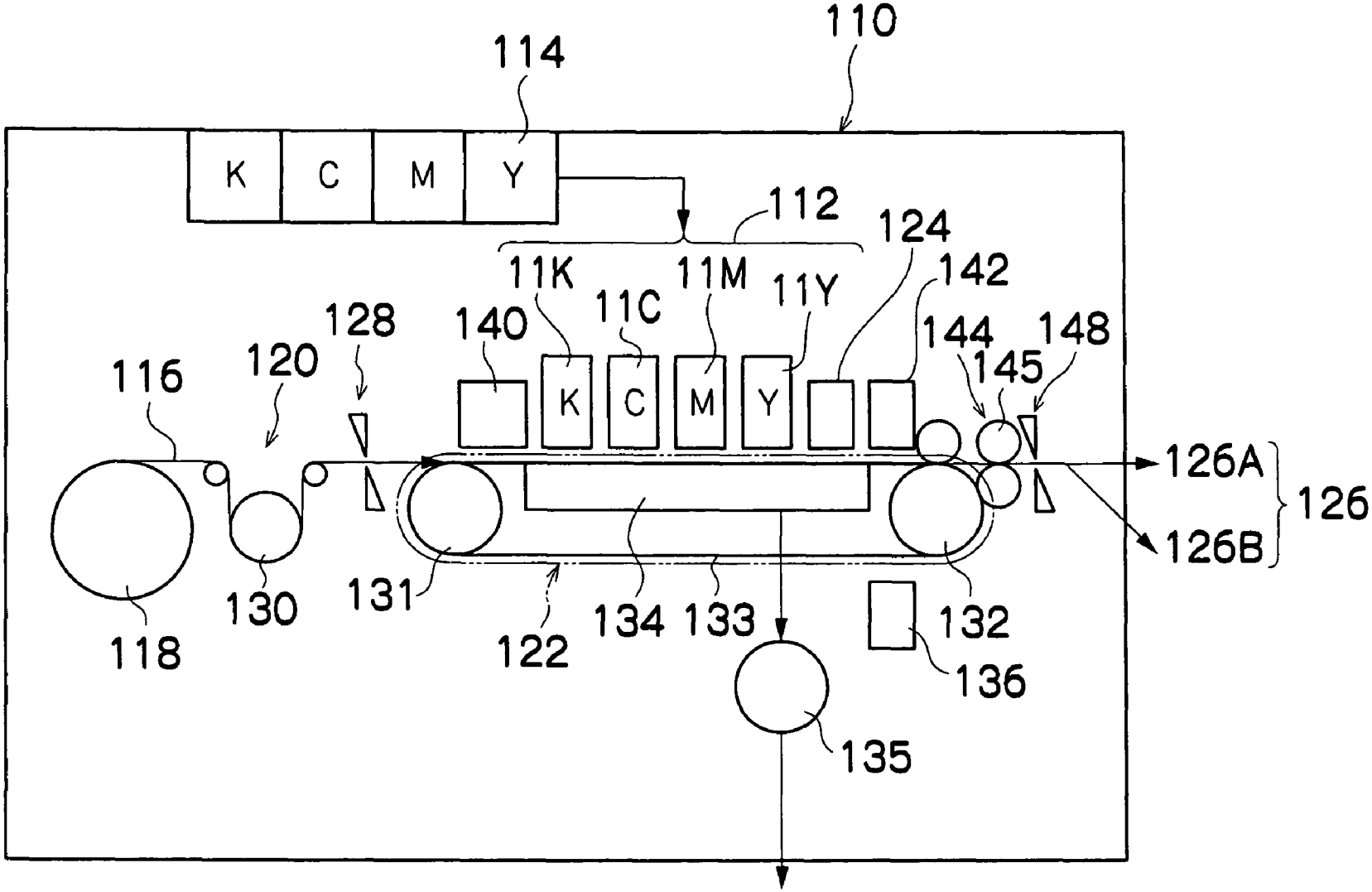
FIG. 11 is a general schematic drawing of an inkjet recording apparatus which comprises a liquid droplet ejection mechanism according to an embodiment of the present invention.

FIG. 11 is a general configuration diagram of an inkjet recording apparatus including an image forming apparatus according to an embodiment of the present invention. As shown in FIG. 11, the inkjet recording apparatus 110 comprises: a print unit 112 having a plurality of inkjet recording heads (hereafter, called "heads") 11K, 11C, 11M, and 11Y provided for ink colors of black (K), cyan (C), magenta (M), and yellow (Y), respectively; an ink storing and loading unit 114 (liquid droplet ejection mechanism of the present invention) for storing inks of K, C, M and Y to be supplied to the print heads 11K, 11C, 11M, and 11Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the print unit 112, for conveying the recording paper 116 while keeping the recording paper 116 flat; a print determination unit 124 for reading the printed result produced by the print unit 112; and a paper output unit 126 for outputting image-printed recording paper (printed matter) to the exterior.

The ink storing and loading unit 114 is a portion relating to the liquid droplet ejection mechanism of the present embodiment, and although not shown in FIG. 11, first ink tanks 12 and second ink tanks 13 which store inks of colors corresponding to the heads 11K, 11C, 11M and 11Y are provided, and the respective tanks are connected to the heads 11K, 11C, 11M and 11Y via a first common flow channel 21, an ink supply channel 23, a second common flow channel 22, and prescribed tubing channels of the ink circulation channel 24 as shown in FIG. 2. Since the detailed composition is described above, further detailed description is not given here.

The ink storing and loading unit 114 has a warning device (for example, a display device or an alarm sound generator) for warning when the remaining amount of any ink is low, and has a mechanism for preventing loading errors among the colors.

In FIG. 11, a magazine for rolled paper (continuous paper) is shown as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine.

In the case of the configuration in which roll paper is used, a cutter (first cutter) 128 is provided as shown in FIG. 11, and the continuous paper is cut into a desired size by the cutter 128.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the print unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the print unit 112 on the interior side of the belt 133, which is set around the rollers 131 and 132, as shown in FIG. 11. The suction chamber 134 provides suction with a fan 135 to generate a negative pressure, and the recording paper 116 is held on the belt 133 by suction.

The belt 133 is driven in the clockwise direction in FIG. 11 by the motive force of a motor being transmitted to at least one of the rollers 131 and 132, which the belt 133 is set around, and the recording paper 116 held on the belt 133 is conveyed from left to right in FIG. 11.

Since ink adheres to the belt 133 when a marginless print job or the like is performed, a belt-cleaning unit 136 is disposed in a predetermined position (a suitable position outside the printing area) on the exterior side of the belt 133.

A heating fan 140 is disposed on the upstream side of the print unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 12:
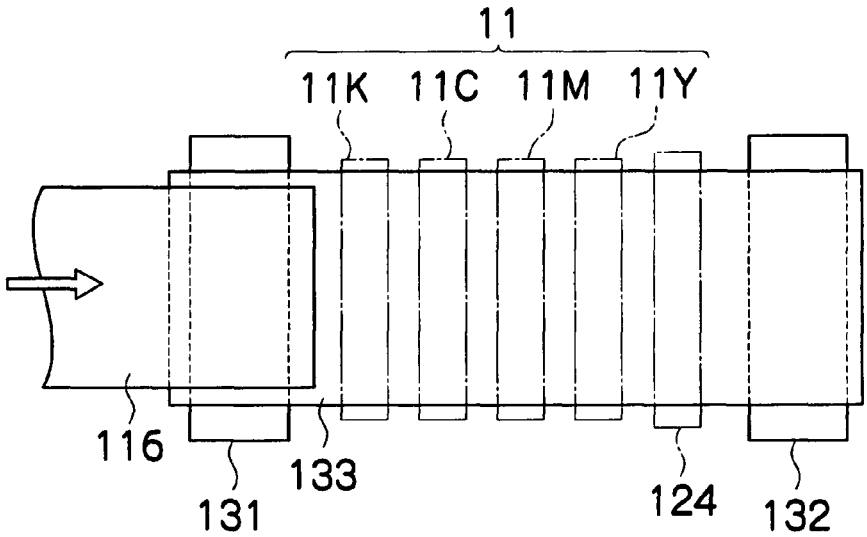
FIG. 12 is a plan view of the principal part of the peripheral area of a print unit in the inkjet recording apparatus illustrated in FIG. 11.

The heads 11K, 11C, 11M and 11Y of the print unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 12).

The print heads 11K, 11C, 11M and 11Y are arranged in color order (black (K), cyan (C), magenta (M), yellow (Y)) from the upstream side in the feed direction of the recording paper 116, and these respective heads 11K, 11C, 11M and 11Y are fixed extending in a direction substantially perpendicular to the conveyance direction of the recording paper 116.

A color image can be formed on the recording paper 116 by ejecting inks of different colors from the heads 11K, 11C, 11M and 11Y, respectively, onto the recording paper 116 while the recording paper 116 is conveyed by the belt conveyance unit 122.

By adopting a configuration in which the full line heads 11K, 11C, 11M and 11Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (the sub-scanning direction), in other words, by means of a single sub-scanning action.

In the present example, a composition having the (four) standard colors of K, C, M and Y was described, but the number and combination of the ink colors is not limited to the present embodiment.

The print determination unit 124 illustrated in FIG. 11 has an image sensor (line sensor or area sensor) for capturing an image of the droplet ejection result of the print unit 112, and functions as a device to check the ejection characteristics, such as blockages, landing position error, and the like, of the nozzles, on the basis of the image of ejected droplets read in by the image sensor.

A CCD area sensor in which a plurality of photoreceptor elements (photoelectric transducers) are arranged two-dimensionally on the light receiving surface is suitable for use as the print determination unit 124 of the present example. An area sensor has an imaging range which is capable of capturing an image of at least the full area of the ink ejection width (image recording width) of the respective heads 11K, 11C, 11M and 11Y.

Furthermore, it is also possible to use a line sensor instead of the area sensor. In this case, a desirable composition is one in which the line sensor has rows of photoreceptor elements (rows of photoelectric transducing elements) with a width that is greater than the ink droplet ejection width (image recording width) of the print heads 11K, 11C, 11M and 11Y A test pattern or the target image printed by the print heads 11K, 11C, 11M, and 11Y of the respective colors is read in by the print determination unit 124, and the ejection performed by each head is determined.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148.

Structure of the Head

Next, the structure of a head 11 will be described. The heads 11K, 11C, 11M and 11Y of the respective ink colors have the same structure.

Figure 13A:
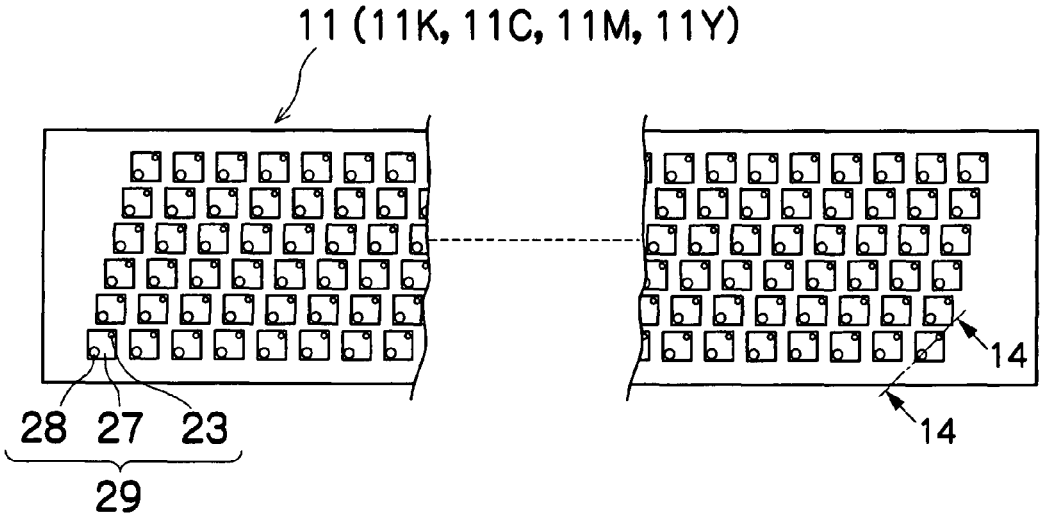
FIG. 13A is a plan view perspective diagram showing an example of the composition of a recording head.
Figure 13B:
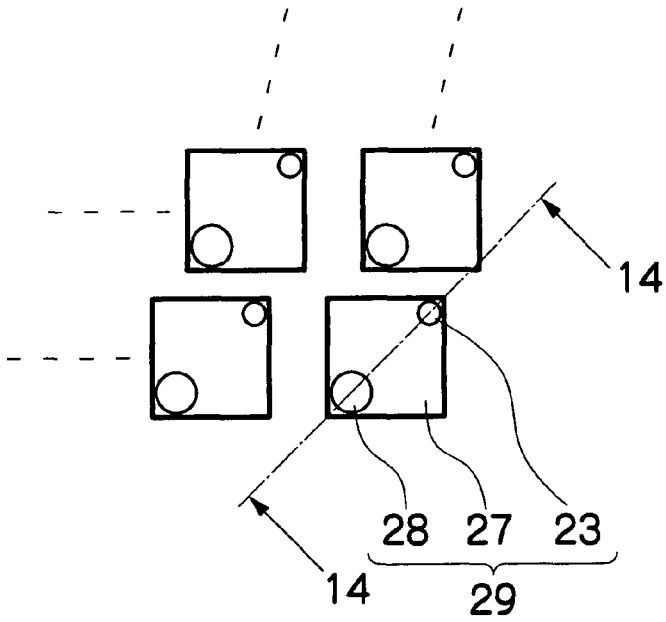
FIG. 13B is an enlarged view of a portion of FIG. 13A.
Figure 13C:
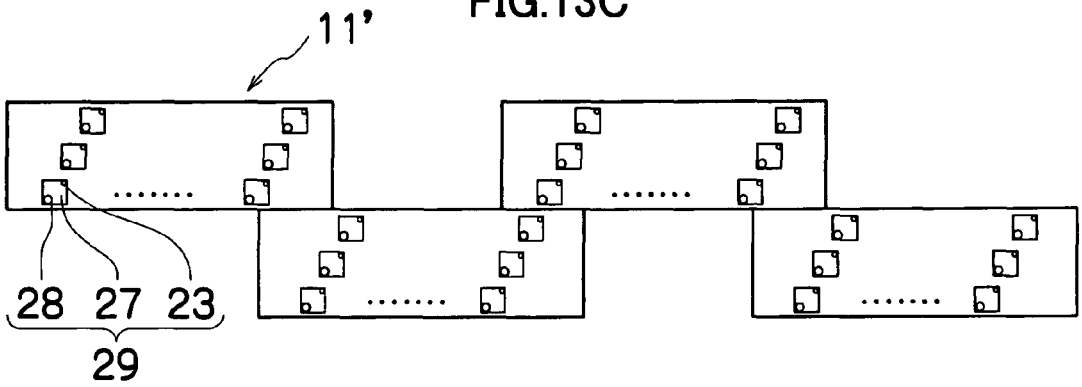
FIG. 13C is a plan view perspective diagram showing a further example of the structure of a recording head.
Figure 14:
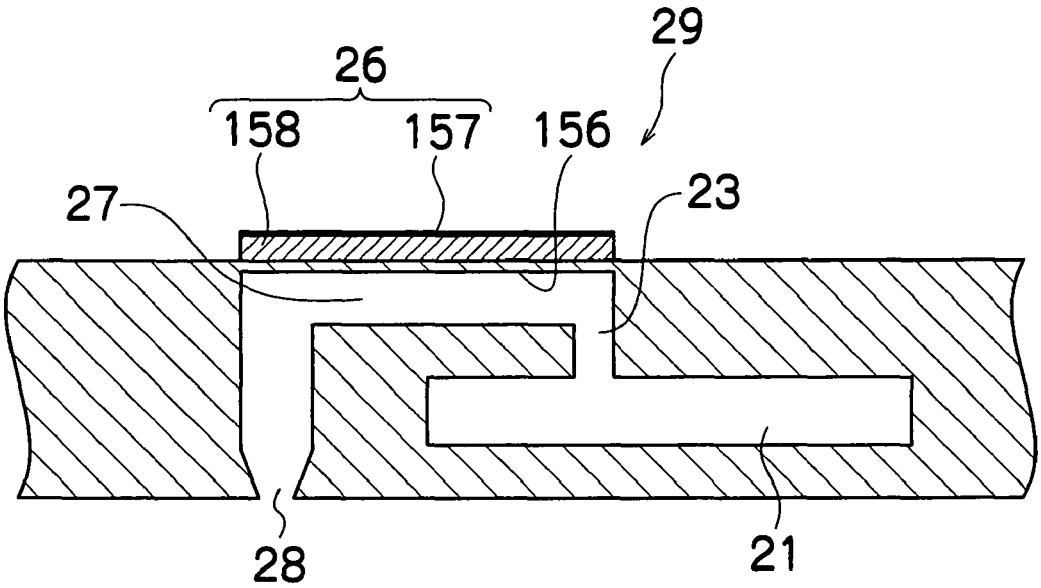
FIG. 14 is a cross-sectional diagram showing the three-dimensional composition of one liquid droplet ejection element (a cross-sectional diagram along line 14-14 in FIG. 13A)

FIG. 13A is a perspective plan view showing an example of the configuration of the head 11, FIG. 13B is an enlarged view of a portion thereof, FIG. 13C is a perspective plan view showing another example of the configuration of the head 11, and FIG. 14 is a cross-sectional view taken along the line 14-14 in FIG. 13A, showing the inner structure of a droplet ejection element (an ink chamber unit for one nozzle 28).

The nozzle pitch in the head 11 should be minimized in order to maximize the density of the dots printed on the surface of the recording paper 116. As shown in FIGS. 13A and 13B, the head 11 according to the present embodiment has a structure in which a plurality of ink chamber units (droplet ejection elements) 29, each comprising a nozzle 28 forming an ink ejection port, a pressure chamber 27 corresponding to the nozzle 28, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the example described above. For example, instead of the configuration in FIG. 13A, as shown in FIG. 13C, a line head having nozzle rows of a length corresponding to the entire width of the recording paper 116 can be formed by arranging and combining, in a staggered matrix, short head blocks 11' having a plurality of nozzles 28 arrayed in a two-dimensional fashion.

As shown in FIGS. 13A and 13B, the planar shape of the pressure chamber 27 provided corresponding to each nozzle 28 is substantially a square shape, and an outlet port to the nozzle 28 is provided at one of the ends of a diagonal line of the planar shape, while an ink supply channel 23 forming an inlet port (supply port) for supplying ink is provided at the other end thereof. The shape of the pressure chamber 27 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 14, each pressure chamber 27 is connected to a first common flow channel 21 through the ink supply channel 23. The first common flow channel 21 is connected to a first ink tank 12 (see FIG. 4), which is a base tank that supplies ink, and the ink supplied from the first ink tank 12 is delivered through the first common flow channel 21 to the pressure chambers 27.

Furthermore, the respective pressure chambers 27 are also connected to the second common flow channel 22 via an ink circulation channel 24, by means of a structure similar to that in FIG. 14. In pressure chambers 27 where ink is not being ejected from the nozzle, the ink is circulated from the first ink tank, to the second ink tank 13, via the first common flow channel 21, the ink supply channel 23, the pressure chamber 27, the ink circulation channel 24 and the second common flow channel 22. Furthermore, the second ink tank 13 also functions as an ink supply source, which is connected to the second common flow channel 22, and ink supplied from the second ink tank 13 is distributed and supplied to the respective pressure chambers 27 via the second common flow channel 22.

An actuator 158 provided with an individual electrode 157 is bonded to a pressure plate (a diaphragm that also serves as a common electrode) 156 which forms the surface of one portion (in FIG. 14, the ceiling) of the pressure chambers 27. In the description given above, an actuator 158 provided with an individual electrode 157 was described as a piezo element 26. When a drive voltage is applied to the individual electrode 157 and the common electrode, the actuator 158 deforms, thereby changing the volume of the pressure chamber 27. This causes a pressure change which results in ink being ejected from the nozzle 28. When the displacement of the actuator 158 returns to its original position after ejecting ink, the pressure chamber 27 is replenished with new ink from the first common flow channel 21, via the ink supply channel 23.

Figure 15:
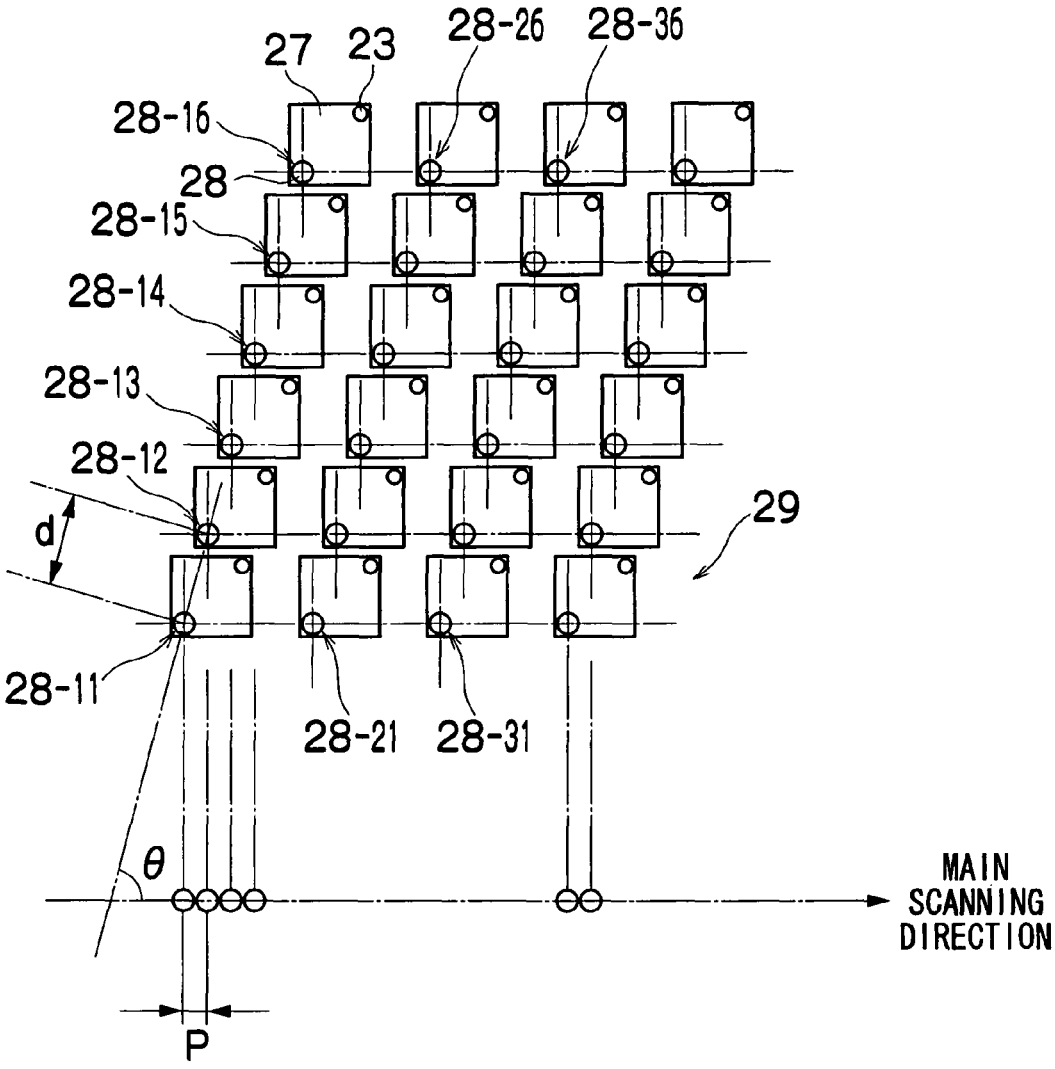
FIG. 15 is an enlarged view showing a nozzle arrangement in the recording head illustrated in FIG. 13A.

As shown in FIG. 15, the high-density nozzle head according to the present embodiment is achieved by arranging a plurality of ink chamber units 29 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 29 are arranged at a uniform pitch d in line with a direction forming an angle of θ with respect to the main scanning direction, the pitch P of the nozzles projected so as to align in the main scanning direction is $d \times \cos\theta$, and hence the nozzles 28 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 28 arranged in a matrix such as that shown in FIG. 15 are driven, the main scanning according to the above-described (3) is preferred. More specifically, the nozzles 28-11, 28-12, 28-13, 28-14, 28-15 and 28-16 are treated as a block (additionally; the nozzles 28-21, 28-22, . . . , 28-26 are treated as another block; the nozzles 28-31, 28-32, . . . , 28-36 are treated as another block; . . . ); and one line is printed in the width direction of the recording paper 116 by sequentially driving the nozzles 28-11, 28-12, . . . , 28-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 16:
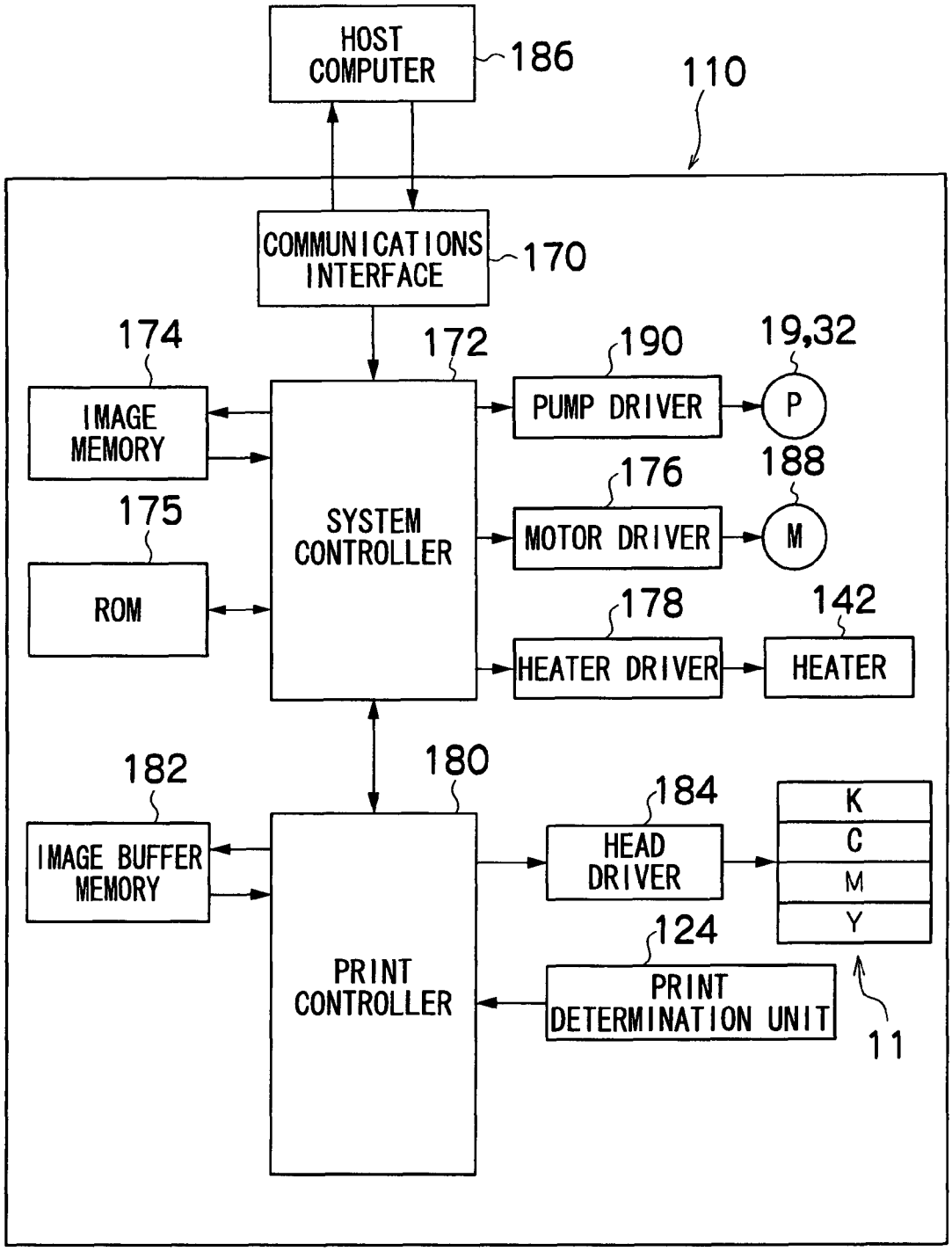
FIG. 16 shows a block diagram showing the system composition of an inkjet recording apparatus.
Figure 17:
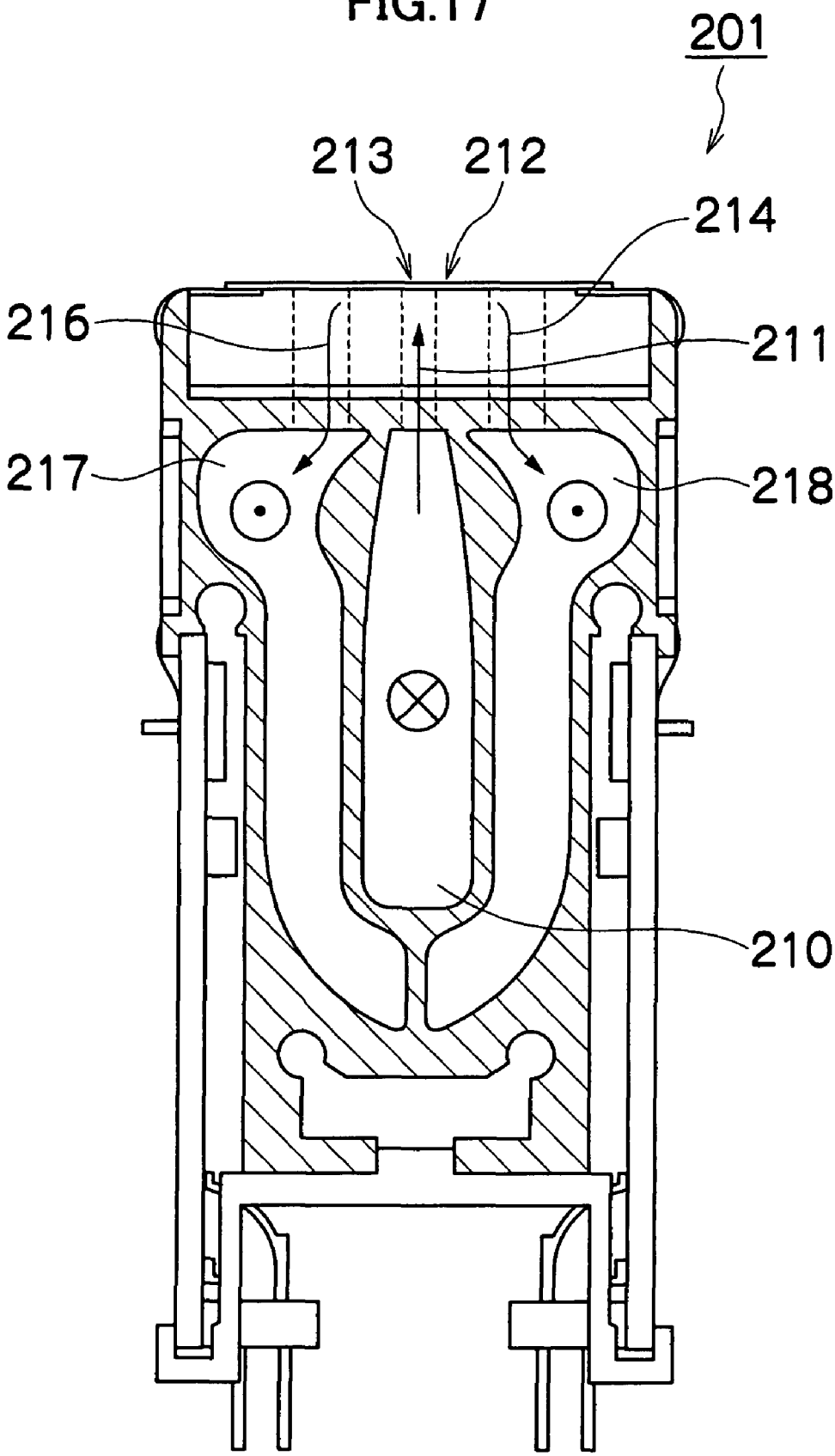
FIG. 17 is a cross-sectional diagram of the print head disclosed in International Publication No. WO00/38928.

FIG. 16 is a block diagram showing the system configuration of the inkjet recording apparatus 110. As shown in FIG. 16, the inkjet recording apparatus 110 comprises a communication interface 170, a system controller 172, an image memory 174, a ROM 175, a motor driver 176, a heater driver 178, a print controller 180, an image buffer memory 182, a head driver 184, a pump driver 190, and the like.

The communication interface 170 is an interface unit (image input unit) which functions as an image input device for receiving image data sent from a host computer 186. A serial interface such as USB (Universal Serial Bus), IEEE1394, Ethernet (registered trademark), wireless network, or a parallel interface such as a Centronics interface may be used as the communication interface 170.

The image data sent from the host computer 186 is received by the inkjet recording apparatus 110 through the communication interface 170, and is temporarily stored in the image memory 174. The image memory 174 is a storage device for temporarily storing images inputted through the communication interface 170, and data is written and read to and from the image memory 174 through the system controller 172.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, pump driver 190, and the like, as well as controlling communications with the host computer 186 and writing and reading to and from the image memory 174 and ROM 175, and it also generates control signals for controlling the motor 188, heater 189, and pump (19, 32) of the conveyance system.

The program executed by the CPU of the system controller 172 and the various types of data (including data for a test pattern for measuring landing position error) which are required for control procedures are stored in the ROM 175.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172. The pump driver 190 is a driver which drives the pump (19, 32) in accordance with instructions from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as a drive control device which controls the ejection driving of the head 11 by supplying the ink ejection data thus generated to the head driver 184.

The image buffer memory 182 is provided with the print controller 180, and image data, parameters, and other data are temporarily stored in the image buffer memory 182 when image data is processed in the print controller 180. FIG. 16 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is input from an external source via a communications interface 170, and is accumulated in the image memory 174. At this stage, multiple-value RGB image data is stored in the image memory 174, for example.

In other words, the print controller 180 performs processing for converting the input RGB image data into dot data for the four colors of K, C, M and Y. The dot data generated by the print controller 180 in this way is stored in the image buffer memory 182. This dot data of the respective colors is converted into CMYK droplet ejection data for ejecting ink from the nozzles of the head 11, thereby establishing the ink ejection data to be printed.

The head driver 184 outputs a drive signal for driving the actuators 158 corresponding to the nozzles 28 of the head 11 in accordance with the print contents, on the basis of the ink ejection data and the drive waveform signals supplied by the print controller 180. A feedback control system for maintaining constant drive conditions for the heads may be included in the head driver 184.

By supplying the drive signal output by the head driver 184 to the head 11 in this way, ink is ejected from the corresponding nozzles 28. By controlling ink ejection from the head 11 in synchronization with the conveyance speed of the recording paper 116, an image is formed on the recording paper 116.

As described above, the ejection volume and the ejection timing of the ink droplets from the respective nozzles are controlled via the head driver 184, on the basis of the ink ejection data generated by implementing prescribed signal processing in the print controller 180, and the drive signal waveform. By this means, prescribed dot sizes and dot positions can be achieved.

The print determination unit 124 is a block that includes the image sensor as described above with reference to FIG. 16, reads the image printed on the recording paper 116, determines the print conditions (presence of the ejection, variation in the dot formation, optical density, and the like) by performing desired signal processing, or the like, and provides the determination results of the print conditions to the print controller 180 and the system controller 172.

The liquid droplet ejection mechanism and the image forming apparatus according to the present invention were described in detail above, but the present invention is not limited to these examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection mechanism comprising:

a first ink tank and a second ink tank which store ink;

a plurality of ink chamber units which are capable of ejecting the ink;

a first common flow channel which connects the first ink tank with the plurality of ink chamber units; and a second common flow channel which connects the second ink tank with the plurality of ink chamber units, wherein:

each of the plurality of ink chamber units includes a pressure chamber which supplies the ink to a nozzle capable of ejecting ink, an ink supply channel which connects the first common flow channel and the pressure chamber, and an ink circulation channel which connects the second common flow channel and the pressure chamber;

the ink supplied from the first ink tank circulates in such a manner that the ink flows through the first common flow channel, the ink chamber units that do not eject the ink, and the second common flow channel to the second ink tank to be recovered in the second ink tank;

the plurality of ink chamber units include a nearest connection ink chamber unit which is connected to the first ink tank at the shortest distance from the first ink tank, of the plurality of ink chamber units, and is also connected to the second ink tank at the shortest distance from the second ink tank, of the plurality of ink chamber units; and taking pressure in the first ink tank to be $P_i$, taking pressure in the second ink tank to be $P_o$, taking volume of the ink circulated per unit time from the first ink tank to the second ink tank when the plurality of ink chamber units do not eject the ink to be $U_o$, taking the ratio between volume of the ink supplied per unit time from the ink supply channel and volume of ink supplied per unit time from the ink circulation channel when the ink is being ejected from at least one of the ink chamber units to be $\alpha_i:\alpha_o$, taking total volume of the ink ejected per unit time from all of the ink chamber units which are ejecting ink to be Q, taking flow channel resistance from a connection section with the first ink tank to a connection section with the nearest connection ink chamber unit in the first common flow channel to be $R_i$, taking the flow channel resistance from a connection section with the second ink tank to a connection section with the nearest connection ink chamber unit in the second common flow channel to be $R_{o1}$, taking flow channel resistance in the first common flow channel between mutually adjacent ink chamber units to be $R_1$, taking the flow channel resistance in the second common flow channel between mutually adjacent ink chamber units to be $R_2$, and taking the total number of ink chamber units to be Z, both following conditions are satisfied:

$$\{Pi-Ri\times(\alpha_i\times Q+U_o)\}\geqq\{P_o-R_{o1}\times(\alpha_o\times Q-U_o)\}, \text{ and}$$

$$[Pi-Ri\times(\alpha_i\times Q+U_o)-R_1\times(Z-1)\times\{(\alpha_1\times Q)/2+U_o/2\}]\geqq[P_o-R_{o1}\times(\alpha_o\times Q-U_o)-R_2\times(Z-1)\times\{(\alpha_o\times Q)/2-U_o/2\}].$$

2. The liquid droplet ejection mechanism as defined in claim 1, wherein the pressure in at least one of the first ink tank and the second ink tank is controlled in such a manner that volume of the ink supplied from the second ink tank when the ink is being ejected becomes equal to volume of the ink circulated from the first ink tank to the second ink tank when the ink is not being ejected.

3. The liquid droplet ejection mechanism as defined in claim 1, wherein the pressure in the second ink tank is controlled according to a liquid head pressure.

4. The liquid droplet ejection mechanism as defined in claim 3, wherein:

the pressure in the first ink tank is controlled according to a liquid head pressure; and taking cross-sectional area of the second ink tank to be $S_2$ and taking cross-sectional area of the first ink tank to be $S_1$, a following condition is satisfied: $S_2<S_1$.

5. The liquid droplet ejection mechanism as defined in claim 3, wherein the pressure in the first ink tank is controlled at a constant level.

6. The liquid droplet ejection mechanism as defined in claim 3, further comprising:

a third ink tank which stores ink;

a measurement device which measures height of a liquid surface in the second ink tank; and a movement device which moves the ink in the second ink tank to the third ink tank, when it is measured by the measurement device that the height of the liquid surface in the second ink tank exceeds a threshold value.

7. An image forming apparatus comprising the liquid droplet ejection mechanism as defined in claim 1.

8. A liquid droplet ejection mechanism comprising:

a first ink tank and a second ink tank which store ink;

a plurality of ink chamber units which are capable of ejecting the ink;

a first common flow channel which connects the first ink tank with the plurality of ink chamber units; and a second common flow channel which connects the second ink tank with the plurality of ink chamber units, wherein:

each of the plurality of ink chamber units includes a pressure chamber which supplies the ink to a nozzle capable of ejecting ink, an ink supply channel which connects the first common flow channel and the pressure chamber, and an ink circulation channel which connects the second common flow channel and the pressure chamber;

the ink supplied from the first ink tank circulates in such a manner that the ink flows through the first common flow channel, the ink chamber units that do not eject the ink, and the second common flow channel to the second ink tank to be recovered in the second ink tank;

the plurality of ink chamber units include: a furthest connection ink chamber unit which is connected to the first ink tank at the greatest distance from the first ink tank and is connected to the second ink tank at the shortest distance from the second ink tank, of the plurality of ink chamber units; and a nearest connection ink chamber unit which is connected to the first ink tank at the shortest distance from the first ink tank and is connected to the second ink tank at the greatest distance from the second ink tank, of the plurality of ink chamber units; and taking pressure in the first ink tank to be $P_i$, taking pressure in the second ink tank to be $P_o$, taking volume of the ink circulated per unit time from the first ink tank to the second ink tank when the plurality of ink chamber units do not eject the ink to be $U_o$, taking the ratio between volume of the ink supplied per unit time from the ink supply channel and volume of ink supplied per unit time from the ink circulation channel when the ink is being ejected from at least one of the ink chamber units to be $\alpha_i:\alpha_o$, taking total volume of the ink ejected per unit time from all of the ink chamber units which are ejecting ink to be Q, taking flow channel resistance from a connection section with the first ink tank to a connection section with the nearest connection ink chamber unit in the first common flow channel to be $R_i$, taking the total number of ink chamber units to be Z, taking flow channel resistance in the first common flow channel between mutually adjacent ink chamber units to be $R_1$, and taking the flow channel resistance from a connection section with the second ink tank to a connection section with the furthest connection ink chamber unit in the second common flow channel to be $R_{oz}$, a following condition is satisfied:

$$[Pi-Ri\times(\alpha_i\times Q+U_o)-R_1\times(Z-1)\times\{(\alpha_i\times Q)/2+U_o/2\}]\geqq(P_o-R_{oz}\times(\alpha_o\times Q-U_o)\}.$$

9. The liquid droplet ejection mechanism as defined in claim 8, wherein the pressure in at least one of the first ink tank and the second ink tank is controlled in such a manner that volume of the ink supplied from the second ink tank when the ink is being ejected becomes equal to volume of the ink circulated from the first ink tank to the second ink tank when the ink is not being ejected.

10. The liquid droplet ejection mechanism as defined in claim 8, wherein the pressure in the second ink tank is controlled according to a liquid head pressure.

11. The liquid droplet ejection mechanism as defined in claim 10, wherein:

the pressure in the first ink tank is controlled according to a liquid head pressure; and taking cross-sectional area of the second ink tank to be $S_2$ and taking cross-sectional area of the first ink tank to be $S_1$, a following condition is satisfied: $S_2<S_1$.

12. The liquid droplet ejection mechanism as defined in claim 10, wherein the pressure in the first ink tank is controlled at a constant level.

13. The liquid droplet ejection mechanism as defined in claim 10, further comprising:

a third ink tank which stores ink;

a measurement device which measures height of a liquid surface in the second ink tank; and a movement device which moves the ink in the second ink tank to the third ink tank, when it is measured by the measurement device that the height of the liquid surface in the second ink tank exceeds a threshold value.

14. An image forming apparatus comprising the liquid droplet ejection mechanism as defined in claim 8.

* * * * *